US010036250B2

(12) United States Patent
Cox et al.

(10) Patent No.: US 10,036,250 B2
(45) Date of Patent: Jul. 31, 2018

(54) RIPPING AND SCRAPING CUTTER TOOL ASSEMBLIES, SYSTEMS, AND METHODS FOR A TUNNEL BORING MACHINE

(71) Applicant: US Synthetic Corporation, Orem, UT (US)

(72) Inventors: Edwin Sean Cox, Spanish Fork, UT (US); Regan Leland Burton, Saratoga Springs, UT (US)

(73) Assignee: US SYNTHETIC CORPORATION, Orem, UT (US)

( * ) Notice: Subject to any disclaimer, the term of this patent is extended or adjusted under 35 U.S.C. 154(b) by 419 days.

(21) Appl. No.: 14/445,774

(22) Filed: Jul. 29, 2014

(65) Prior Publication Data

US 2016/0032724 A1 Feb. 4, 2016

(51) Int. Cl.

| | |
|---|---|
| ***E21D 9/11*** | (2006.01) |
| ***E21C 35/183*** | (2006.01) |
| ***E21D 9/10*** | (2006.01) |
| *E21C 35/18* | (2006.01) |

(52) U.S. Cl.

CPC ..... *E21D 9/11* (2013.01); *E21C 35/183* (2013.01); *E21D 9/104* (2013.01); *E21D 9/112* (2013.01); *E21C 2035/1809* (2013.01)

(58) Field of Classification Search

CPC . E21D 9/104; E21D 9/11; E21D 9/112; E21C 35/183; E21C 2035/1803; E21C 2035/1809; E21C 2035/1813; E21C 2035/1816; E21B 10/46; E21B 10/56; E21B 10/567

See application file for complete search history.

(56) References Cited

U.S. PATENT DOCUMENTS

| | | | | |
|---|---|---|---|---|
| 1,674,870 | A | 6/1928 | Morgan | |
| 4,193,637 | A * | 3/1980 | Spencer | E21B 10/12 299/106 |
| 5,662,387 | A | 9/1997 | Bartkowiak | |
| 5,785,135 | A | 7/1998 | Crawley | |
| 6,196,338 | B1 | 3/2001 | Slaughter et al. | |
| 7,866,418 | B2 | 1/2011 | Bertagnolli et al. | |
| 7,998,573 | B2 | 8/2011 | Qian et al. | |

(Continued)

FOREIGN PATENT DOCUMENTS

WO WO 1999/018325 4/1999

OTHER PUBLICATIONS

International Search Report and Written Opinion from International Application No. PCT/US2015/042528 dated Oct. 28, 2015.

(Continued)

*Primary Examiner* — David J Bagnell
*Assistant Examiner* — Michael A Goodwin
(74) *Attorney, Agent, or Firm* — Dorsey & Whitney LLP

(57) ABSTRACT

Embodiments of the invention generally relate to tunnel boring machine cutter assemblies, such as ripping and scraping cutter or tool assemblies, (collectively "cutter assemblies"), and related methods of use and manufacturing. The various embodiments of the cutter assemblies described herein may be used in tunnel boring machines ("TBMs"), earth pressure balance machines ("EPBs"), raise drilling systems, large diameter blind drilling systems, and other types of mechanical drilling and excavation systems.

18 Claims, 22 Drawing Sheets

(56) References Cited

U.S. PATENT DOCUMENTS

| | | | | |
|---|---|---|---|---|
| 8,034,136 | B2 | 10/2011 | Sani | |
| 8,236,074 | B1 | 8/2012 | Bertagnolli et al. | |
| 9,017,438 | B1 * | 4/2015 | Miess | B24D 3/06 51/293 |
| 9,027,675 | B1 * | 5/2015 | Jones | E21B 10/46 175/425 |
| 9,272,392 | B2 * | 3/2016 | Mukhopadhyay | B01J 3/062 |
| 2009/0256413 | A1 * | 10/2009 | Majagi | B28D 1/188 299/100 |
| 2010/0109419 | A1 * | 5/2010 | Greenspan | E21C 35/183 299/10 |
| 2010/0164274 | A1 | 7/2010 | Kondo et al. | |
| 2010/0237135 | A1 * | 9/2010 | Hall | E21C 35/183 228/121 |
| 2013/0098688 | A1 | 4/2013 | Yong et al. | |
| 2013/0264860 | A1 * | 10/2013 | Meyer | E21D 9/112 299/55 |
| 2014/0225418 | A1 * | 8/2014 | Lachmann | E21C 35/183 299/104 |
| 2015/0028654 | A1 * | 1/2015 | Lehnert | E21C 25/10 299/39.4 |
| 2015/0176408 | A1 * | 6/2015 | Latham | E21C 35/193 299/105 |

OTHER PUBLICATIONS

Roepke, et al. "Drag Bit Cutting Characteristics Using Sintered Diamond Inserts" Report of Investigations 8802, Bureau of Mines Report of Investigations / 1983.

* cited by examiner

RIPPING AND SCRAPING CUTTER TOOL ASSEMBLIES, SYSTEMS, AND METHODS FOR A TUNNEL BORING MACHINE

BACKGROUND

Various mechanical excavations systems may be used in a variety of excavating applications. For example, tunnel boring machines ("TBMs") are commonly used in tunnel excavation. TBMs can bore through any number of materials, from hard rock to sand and can produce tunnels of different diameters. A typical TBM includes a rotating cutterhead that chips, cracks, scrapes, rips, and otherwise removes material during rotation. More specifically, TBMs may include ripping and scraping tools that may engage material as the cutterhead rotates. Furthermore, as the cutterhead removes material, the TBM may advance the cutterhead to facilitate further engagement of the cutterhead with material. Likewise, the TBM may press the cutterhead against material to provide engagement of the cutterhead with the material.

After the material fails due to engagement with the cutterhead as the cutterhead rotates, the failed material is collected and removed as debris. As the ripping and scraping tools engage and fail the material, however, the tools commonly experience wear and/or breakage, which leads to failure or reduced effectiveness of the tools. Moreover, failure or reduced effectiveness of the tools may necessitate removal and replacement thereof. As such, the useful life of the tools may be a significant limitation in the operating efficiency of mechanical excavation systems using these tools, such as the TBMs.

For example, while the tools may be replaced, the mechanical excavation systems may require stoppage to change out the tools. Moreover, such stoppage may last several hours, as technicians remove, replace, and/or repair the tools. This time- and effort-intensive repair activity reduces the overall efficiency or rate of mechanical excavation systems using the disc cutters.

Therefore, manufacturers and users of mechanical excavation systems continue to seek improved ripping and scraping tools as well as manufacturing techniques therefor.

SUMMARY

Embodiments of the invention generally relate to tunnel boring machine cutter assemblies, such as ripping and scraping cutter or tool assemblies (collectively "cutter assemblies"), and related methods of use and manufacturing. The various embodiments of the cutter assemblies described herein may be used in TBMs, earth pressure balance machines ("EPBs"), raise drilling systems, large diameter blind drilling systems, and other types of mechanical drilling and excavation systems. In some embodiments, the cutter assemblies may include multiple superhard cutter elements that may engage, disrupt, and fail target material. As used herein' the term "target material" refers to material targeted for failing and/or removal. In particular, such superhard cutter elements may exhibit a relatively high wear resistance, which may increase the useful life of the cutter assemblies (as compared with conventional cutter assemblies, such as conventional rippers and scrapers).

Embodiments include a cutter assembly for mounting on a cutterhead of a TBM and engaging a target material. The cutter assembly includes a support block sized and configured to be attached to the cutterhead of the TBM and a plurality of superhard cutter elements (e.g., a plurality of PCD cutter elements). Each superhard cutter element includes a superhard working surface. Moreover, the superhard cutter elements are secured to the support block and oriented in a manner to engage the target material during movement (e.g., rotation) of the cutterhead of the TBM.

Embodiments also include a cutterhead for a TBM. The cutterhead includes a front surface oriented approximately perpendicular to a rotation axis, and a plurality of cutter assemblies protruding outward from the front surface. Each cutter assembly includes a support block, and a plurality of superhard cutter elements secured to the support block.

Embodiments also include a TBM for engaging, failing, and excavating target material. The TBM includes a rear portion configured to be secured relative to the target material and a cutterhead rotatably connected to the rear portion. The cutterhead has a front surface. Furthermore, the cutterhead is moveable into the target material. The TBM also includes a plurality of cutter assemblies secured to the cutterhead and positioned and oriented on the cutterhead in a manner to engage target material during rotation of the cutterhead. Each cutter assembly of the plurality of cutter assemblies includes a support block and a plurality of superhard cutter elements (e.g., a plurality of PCD cutter elements) secured to the support block.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments, wherein identical reference numerals refer to identical or similar elements or features in different views or embodiments shown in the drawings.

DETAILED DESCRIPTION

Figure 1A:
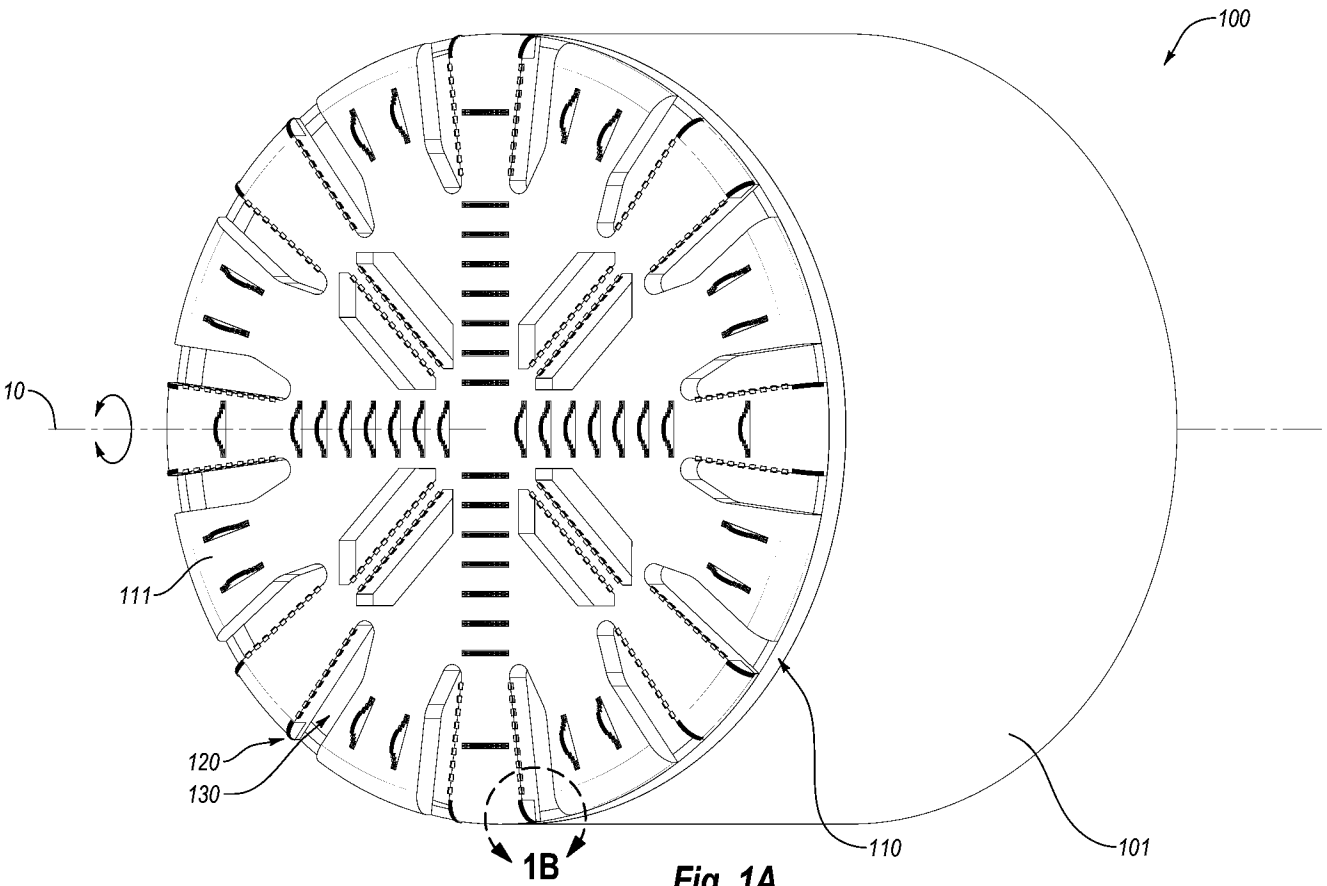
FIG. 1A is an isometric view of a tunnel boring machine according to an embodiment of the invention.

Embodiments of the invention generally relate to tunnel boring machine cutter assemblies, such as ripping and scraping cutter or tool assemblies, (collectively "cutter assemblies"), and related methods of use and manufacturing. The various embodiments of the cutter assemblies described herein may be used in TBMs, earth pressure balance machines ("EPBs"), raise drilling systems, large diameter blind drilling systems, and other types of mechanical drilling and excavation systems. In some embodiments, the cutter assemblies may include multiple superhard cutter elements that may engage, disrupt, and fail target material. In particular, such superhard cutter elements may exhibit a relatively high wear resistance, which may increase the useful life of the cutter assemblies (as compared with conventional cutter assemblies, such as conventional rippers and scrapers).

In some embodiments, the cutter assembly is secured to a cutterhead of the TBM machine. Hence, as the cutterhead rotates about an axis of rotation, the cutter assembly also may rotate about the axis of rotation and engage the target material. The cutterhead may have a clockwise rotational direction and/or counterclockwise direction of rotation (i.e., TBM may rotate the cutterhead in either clockwise or counterclockwise direction). Similarly, the cutting direction or direction of movement of cutter assembly may vary from one embodiment to another. Embodiments may include working surfaces of the superhard cutter elements approximately oriented along the direction of rotation of the cutterhead (or direction of movement of the cutter assembly). For example, a working surface of the superhard cutter element may engage the target material during use or operation. In some embodiments, rotation of the cutterhead may produce such engagement of the superhard cutter elements with the target material in a manner that fails the target material.

The superhard cutter elements as well as the working surfaces and cutting edges thereof may have any number of suitable configurations that may vary from one embodiment to the next. In some embodiments, at least some of the superhard cutter elements may have approximately cylindrical shapes. Alternatively or additionally, the superhard cutter elements may have rectangular or square, triangular, polygonal, or irregular-shaped cross-sectional geometries. In any case, the superhard cutter elements may be secured to and/or within a support block that may be attached to the cutterhead of the TBM. In an embodiment, the working surfaces and/or the cutting edges of the superhard cutter elements may be positioned beyond a front surface of the cutterhead. For example, as the cutterhead advances toward and/or into the target material, the working surface and/or cutting edges may engage the target material, while the front surface of the cutter head may remain spaced away from the target material.

The working surface of the superhard cutter elements may have any number of suitable shapes, which may vary from one embodiment to the next. In some examples, the working surfaces may have a domed or a generally pointed shape, such as a hemispherical, a semispherical, an approximately conical shape with a rounded apex, or the like. Alternatively, the working surfaces may be planar or approximately planar, multi-faceted, or irregularly shaped. Furthermore, in one or more embodiments, the working surfaces may include superhard material. As used herein, "superhard material" includes materials exhibiting a hardness that is at least equal to the hardness of tungsten carbide (i.e., a portion or the entire working surface may have a hardness that exceeds the hardness of tungsten carbide). In any of the embodiments disclosed herein, the cutter assemblies and the superhard cutter elements may include one or more superhard materials, such as polycrystalline diamond, polycrystalline cubic boron nitride, silicon carbide, tungsten carbide, or any combination of the foregoing superhard materials. For example, a superhard cutter element may include a substrate and a superhard material bonded to the substrate, as described in further detail below.

Figure 1B:
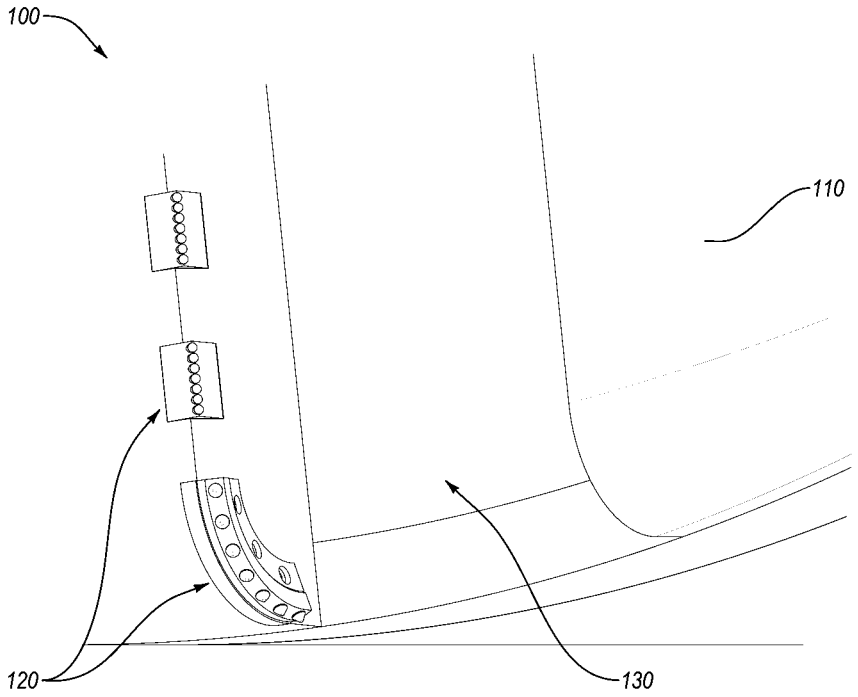
FIG. 1B is a partial, enlarged, isometric view of the tunnel boring machine of FIG. 1A.

As mentioned above, the cutter assemblies may be mounted or attached to the cutterhead of the TBM. FIGS. 1A-1B illustrate is a schematic isometric view of a TBM 100 according to an embodiment. The TBM 100 includes a rotatable cutterhead 110 positioned at a front end of the TBM 100. The cutterhead 110 may be configured to rotate in a clockwise and/or counterclockwise direction about a rotation axis 10, as indicated by arrows. In an embodiment, the cutterhead 110 may have an approximately circular perimeter (i.e., an approximately cylindrical peripheral surface). In additional or alternative embodiments, the perimeter of the cutterhead 110 may have any suitable shape, such as square, rectangular, triangular, etc.

In some embodiments, the rotation axis 10 may be generally coaxial with the geometry of the excavation (e.g., concentric with a circular cross-section of a tunnel). The size of the TBM 100 (e.g., the size of the cutterhead 110) may vary from one embodiment to another. In some embodiments, the TBM 100 may have an approximately one meter diameter; in other embodiments, the TBM 100 may have an approximately 20 meter diameter. It should be appreciated that the TBM 100 may be about 1 meter in diameter to about 20 meters in diameter. In other embodiments, the TBM 100 may be less than 1 meter in diameter or greater than 20 meters in diameter.

In an embodiment, one or more cutter assemblies 120 may be at least one of mounted on, attached to, or integrated with the cutterhead 110. Generally, the cutter assemblies 120 may protrude outward from a front surface 111 of the cutterhead 110 (i.e., in the cutting direction) and may be attached to the cutterhead 110 in any number of suitable ways, which may vary from one embodiment to the next. For example, at least some of the cutter assemblies 120 may be secured to the cutterhead 110 with one or more fasteners in a manner that facilitates service, removal, and replacement of such cutter assemblies 120. Alternatively or additionally, a clamping mechanism may secure the cutter assembly 120 to the cutterhead 110. In some embodiments, the cutter assemblies 120 may be welded to the cutterhead 110. In any event, in some embodiments, the cutter assemblies 120 may be removably secured to the cutterhead 110.

In an embodiment, the cutter assemblies 120 may be mounted to the cutterhead 110 in one or more patterns, such that as the cutterhead 110 rotates about the rotation axis 10, the cutter assemblies 120 can contact or engage the target material. Hence, the cutter assemblies 120 may be configured to for cutting, scraping, or otherwise failing the target material (e.g., rock, sand, gravel, etc.). For example, as the cutterhead 110 rotates and advances, the cutter assemblies 120 also rotate about the rotation axis 10 and are pressed or forced against the target material, thereby engaging and failing the target material. For example, a system of hydraulic cylinders (not shown) may advance the cutterhead 110 toward and into the target material.

As the cutter assemblies 120 engage the target material, movement of the cutter assembly 120 through the target material may fracture, crush, break, rip, scrape, or otherwise fail and loosen the excavated material from the bulk of the target material. In some embodiments, the excavated material may enter one or more removal channels, such as removal channels 130, which may pass through the front surface 111 of the cutterhead 110. It should be noted that the front surface 111 of the cutterhead 110 may have any number of suitable configurations. In some embodiments, the front surface 111 of the cutterhead 110 may be substantially planar. Alternatively, the front surface 111 of the cutterhead 110 may have a convex shape, a concave shape, undulations, as well as other suitable shapes. Moreover, in some embodiments, the front surface 111 of the cutterhead 110 may be oriented at approximately 90° angle relative to the rotation axis 10. Alternatively, however, the front surface may have a substantially non-orthogonal orientation relative to the rotation axis 10.

As illustrated in FIG. 1B, in an embodiment, the cutter assembly 120 may be located adjacent to the removal channels 130. As the TBM 100 fails the target material and produces excavated material, rotation of the cutterhead 110 may move the cutter assembly 120 through the target material as well as through the excavated material such that the cutter assembly 120 sweeps or moves the excavated material into the removal channels 130.

Subsequently, the excavated material may be transported away from the cutterhead 110 and out of the TBM 100. As the target material is excavated and removed, the tunnel length increases, and the TBM 100 may advance farther into the tunnel, maintaining engagement of the cutterhead 110 with the target material. In some embodiments, a portion of the TBM 100 may be anchored or otherwise secured to and/or within the tunnel opening, while pressing the cutterhead 110 against the target material. For example, hydraulic cylinders may be deployed along with mechanisms that may press against the surface of the tunnel opening, thereby maintaining a portion (e.g., a rear portion 101) of the TBM 100 stationary as the cutterhead 110 is pressed against the target material. In an embodiment, the cutterhead 110 may be rotatably and movably coupled or connected to the rear portion 101. Hence, as the rear portion 101 remains fixed or stationary relative to the tunnel or ground, the cutterhead 110 may be rotated and advanced into the target material.

As described above, the cutter assembly 120 may include superhard cutter elements sized and configured to engage and fail the target material as the cutterhead 110 rotates and advances therein. Configuration of the cutter assembly 120 may vary from one embodiment to the next and may depend on the specifics of the material target for excavation, among other things. In an embodiment illustrated in FIG. 2A, a cutter assembly 120*a* may include a support block 140*a* and a plurality of superhard cutter elements, such as superhard cutter elements 150*a*, 150*a*' (not all labeled in FIG. 2A), which may be secured to and/or within the support block 140*a*. Each of the superhard cutter elements 150*a*, 150*a*' may include one or more respective superhard working surfaces 151*a*, 151*a*' that may engage and fail the target material. Except as otherwise described herein, the cutter assembly 120*a* and its materials, elements, features, or components may be similar to or the same as the cutter assembly 120 (FIGS. 1A-1B) and its respective materials, elements, features, and components.

The superhard cutter elements 150*a*, 150*a*' may be secured to the support block 140*a* in any number of suitable ways. For example, the superhard cutter elements 150*a*, 150*a*' may be at least partially secured within respective recesses in the support block 140*a* by brazing, press-fitting, threadedly attaching, fastening with a fastener, combinations of the foregoing, or another suitable technique. In any event, the superhard cutter elements 150*a*, 150*a*' may be removably or non-removably secured to the support block 140*a* in a manner that maintains the superhard cutter elements 150*a*, 150*a*' attached to the support block 140*a* during operation of the cutter assembly 120*a*.

The support block 140*a* may have any shape and size suitable for securing the superhard cutter elements 150*a*, 150*a*' in a manner that facilitates engagement thereof with the target material. In the embodiment illustrated in FIG. 2A, the support block 140*a* has a generally cuboid or bar-shaped configuration. The support block 140*a* may include a mounting surface 141*a*, which may be oriented generally orthogonally to the front surface 111 of the cutterhead 110 when the cutter assembly 120*a* is mounted on the cutterhead 110. In some embodiments, the mounting surface 141*a* also may include mounting features that may facilitate securing the support block 140*a* to the cutterhead (e.g., bolt holes, dovetail connections, shoulders that may be secured in undercuts or with clamps, snap-in features, etc.).

Additionally, the support block 140*a* may include a single slanted surface or multiple slanted surfaces, which may facilitate cutting or ripping of the target material by the superhard cutter elements 150*a*, 150*a*' and/or by the support block 140*a*. For example, the support block 140*a* may include longitudinally slanting surfaces, such as a longitudinal slanted surface 142*a* that may form a non-parallel and non-orthogonal angle relative to the mounting surface 141*a*. Specifically, the slanted surface 142*a* may extend at least partially along a length (as measured along longitudinal axis 35*a*) of the support block 140*a* and may form or define an upper portion of the support block 140*a*.

In some embodiments, the support block 140*a* also may have a second longitudinal slanted surface 143*a*, which may be a mirrored orientation/geometry of the slanted surface 142*a* (e.g., about a centerline of the support block 140*a*, such as vertical centerline 30*a* extending through the geometric center of the support block 140*a*). In other words, the slanted surfaces 142*a*, 143*a* may be symmetrical about the vertical centerline 30*a* of the support block 140*a*. Furthermore, in some embodiments, the slanted surfaces 142*a* and 143*a* may form a crest or edge 146*a* of the support block 140*a* (e.g., the edge 146*a* may form or define an upper edge of the support block 140*a*).

It should be appreciated that, unless otherwise expressly stated, all references to a "centerline" (e.g., references to a centerline of a cutter assembly, support block, superhard cutter elements, etc.) are used for descriptive purposes only. As such, references to a "centerline" are intended to provide orientation and/or positional references for describing elements and/or components of the cutter assembly. In some embodiments, the referenced "centerline" may coincide with a true center or line a line of symmetry of the cutter assembly or another referenced element or component thereof. In alternative embodiments, however, the referenced "centerline" does not necessarily coincide with a true center or line of symmetry of the cutter assembly or referenced element or component thereof. Furthermore, in some embodiments, when a cutter assembly is mounted on the cutterhead, the vertical centerline 30*a* of the cutter assembly may be substantially perpendicular to the front surface of the cutterhead (e.g., the front surface of the cutterhead may be substantially planar and/or may lie in an imaginary plane, and when the cutter assembly 120*a* is attached to the cutterhead, the vertical centerline 30*a* of the cutter assembly 120*a* may be substantially perpendicular to the imaginary plane of the front surface of the cutterhead).

As the support block 140*a* moves through the target material, the slanted surfaces 142*a*, 143*a* may provide relief, such that a smaller surface area of the support block 140*a* contacts the target material (as compared with support block shaped as a rectangular prismoid). For example, any of the slanted surfaces 142*a*, 143*a* may lie below superhard working surfaces of one or more superhard cutter elements 150*a*', 150*a*', such that the superhard cutter elements may at least partially fail and/or remove the target material, thereby reducing or minimizing contact between the target material and the slanted surfaces 142*a*, 143*a*. Reduced contacting surface area of the support block 140*a* with the target material may reduce friction of the support block 140*a* with the target material and may reduce wear of the support block 140*a* as well as reduce the amount of energy expended on rotation of the cutterhead.

Similarly, the support block 140*a* may include side-slanted surfaces, such as side-slanted surfaces 144*a*, 145*a*, which may form a non-parallel and/or non-orthogonal angle with the mounting surface 141*a*. Furthermore, the side-slanted surfaces 144*a*, 145*a* may form a non-parallel and non-orthogonal angle relative to the mounting surface 141*a* and relative to the slanted surface 142*a* of the support block 140*a*. The side-slanted surfaces 144*a*, 145*a* also may extend away from an imaginary plane defined by the vertical centerline 30*a* and longitudinal centerline 35*a*. In an embodiment, the side-slanted surfaces 144*a*, 145*a* may form non-parallel angles with the imaginary plane defined by the vertical centerline 30*a* and longitudinal centerline 35*a*.

In an embodiment, the mounting surface 141*a* may be approximately parallel to the imaginary plane defined by the vertical centerline 30*a* and longitudinal centerline 35*a*. Thus, for example, the side-slanted surfaces 144*a*, 145*a* may have a non-parallel orientation relative to the mounting surface 141*a*. Furthermore, the side-slanted surfaces 144*a*, 145*a* may form a ridge or an edge 147*a* therebetween, from which the side-slanted surfaces 144*a*, 145*a* may extend (e.g., the edge 147*a* may lie along the imaginary plane defined by the vertical centerline 30*a* and longitudinal centerline 35*a*).

The side-slanted surface 145*a* may have a mirrored orientation/geometry with respect to the 144*a* about the edge 147*a*. Also, in some embodiments, the edge 147*a* may be aligned with the longitudinal centerline 35*a*. Under some operating conditions, the edges 147*a* and 146*a* may aid in scraping the failed material into the openings in the cutterhead. As described above, after the failed material enters the openings in the cutterhead, the failed material may be transported away from the TBM.

In some embodiments, the support block 140*a* also may include side-slanted surfaces 148*a*, 149*a*, which may form edges or ridges with the side-slanted surfaces 144*a*, 145*a*, respectively (e.g., the side-slanted surfaces 148*a* and 144*a* may form an edge 153*a*). In an embodiment, the side-slanted surfaces 148*a*, 149*a* may form an edge or a ridge 154*a* therebetween. For example, the side-slanted surface 148*a* may have a mirrored orientation/geometry with respect to the side-slanted surface 149*a* about the ridge 154*a*. Alternatively, a surface may be formed between the side-slanted surfaces 148*a*, 149*a*.

Moreover, the side-slanted surfaces 148*a*, 149*a* may lie in an imaginary plane that is approximately parallel to the vertical centerline 30*a* of the support block 140*a*. In some embodiments, the edge 154*a* may lie in the same imaginary plane as the edge 147*a* (e.g., the edge 154*a* and the ridge 147*a* may lie in the imaginary plane defined by the vertical and longitudinal centerlines 30*a*, 35*a*). Similarly, the edge 147*a* may be aligned with or may lie in the same imaginary plane as the edge 146*a* (e.g., edges 146*a*, 147*a* may lie in the imaginary plane defined by the vertical and longitudinal centerlines 30*a*, 35*a*). In some embodiments, at least some of the superhard cutter elements 150*a*, 150*a*' may extend from one or more surfaces extending between the slanted surfaces 142*a*, 143*a*, between the side-slanted surfaces 144*a*, 145*a*, between the side-slanted surfaces 148*a*, 149*a*, or combinations thereof.

Depending on the particular orientation on the cutterhead, in some embodiments, the cutter assembly 120*a* may move along the longitudinal centerline 35*a* and/or along a crosswise centerline 40*a* that is substantially perpendicular to the longitudinal centerline 35*a*. Accordingly, in some embodiments, the superhard cutter elements 150*a*, 150*a*' may be oriented such that the superhard working surfaces 151*a*, 151*a*' generally face in any selected direction (e.g., in the direction of rotation of the cutterhead of the TBM), such as to produce a desired or suitable cutting or ripping action when engaging the target material. In other words, as the cutter assembly 120*a* moves with the rotating cutterhead, the superhard working surfaces 151*a*, 151*a*' may move through the target material in a manner that cuts, rips, or otherwise fails the target material and produces excavated material. It should be appreciated that references to the cutting direction are intended for descriptive purposes only and provide only some examples of suitable directions of movement of the cutter assemblies during operation thereof. Thus, such references are not intended to be limiting.

In some embodiments, an axis of the superhard cutter elements 150*a*, 150*a*' (e.g., a center axis) may be oriented at a non-parallel angle relative to the longitudinal centerline 35*a* and/or relative to the crosswise centerline 40*a* of the cutter assembly 120*a*. For example, at least some of the cutter elements 150*a* and/or 150*a*' may be oriented such that the axes thereof may form acute angles relative to an imaginary plane formed by the longitudinal centerline 35*a* and crosswise centerline 40*a*. As noted above, the superhard working surface may include any number of suitable shapes. In at least one example, the superhard working surfaces 151*a* may have cone shapes that may have any number suitable angles. For example, the cone of each of the superhard working surfaces 151*a* may be a 90° angle or other suitable angle. Moreover, in an embodiment, the cone of the superhard working surfaces 151*a* may include a concave surface 152*a* (e.g., a hemispherical or a semispherical portion a tip of the cone) that may blend with the peak of the conical surface of the superhard cutter elements 150*a*.

In some embodiments, the cutter assembly 120*a* may include multiple superhard cutter elements 150*a*, which may be arranged in any number of suitable configurations. In an embodiment, the superhard cutter elements 150*a* may be positioned in multiple rows along the length of the support block 140*a* (e.g., the rows may be substantially parallel to the longitudinal centerline 35*a* when viewed along vertical centerline 30*a*). More specifically, each row may include one or more of the superhard cutter elements 150*a* and may be spaced from each adjacent row. For example, the cutter assembly 120*a* may include an uppermost row of the superhard cutter elements 150*a*, which may be located at and/or may follow approximately the longitudinal centerline of the support block 140*a* when viewed along vertical centerline 30*a*.

As described above, in an embodiment, at least some of the superhard cutter elements 150*a*, 150*a*' may be secured within recesses in the support block 140*a*. In some embodiments, such recesses may at least partially orient the superhard cutter elements 150*a* and/or 150*a*' relative to the support block 140*a*. For example, center axes of at least some of the superhard cutter elements 150*a* may have a non-parallel orientation relative to the vertical centerline 30*a* of the support block 140*a*. More specifically, in some embodiments, the center axes of at least some of the superhard cutter elements 150*a* may form an acute angle with an imaginary plane formed by the vertical centerline 30*a* and crosswise centerline 40*a*.

In addition, in an embodiment, the center axis of each of the superhard cutter elements 150*a* may form the same angle with the imaginary plane formed by the vertical centerline 30*a* and crosswise centerline 40*a*. Alternatively, center axes of some or all of the superhard cutter elements 150*a* may form angles with the imaginary plane formed by the vertical centerline 30*a* and crosswise centerline 40*a* that are different from one another. In any event, the superhard cutter elements 150*a* may be oriented in a manner that movement of the cutter assembly 120*a*, while engaged with the target material, may produce ripping, scraping, or otherwise failing the target material by the superhard cutter elements 150*a*.

In an embodiment, the superhard cutter elements 150*a* may be located on the support block 140*a* such that as the cutter assembly 120*a* enters the target material, the superhard cutter elements 150*a* engage the target material. In some embodiments, the superhard cutter elements 150*a* may engage the target material at various depths and/or along multiple cutting paths. As such, the superhard cutter elements 150*a* may cut or rip through different layers or portions of the target material, which may be at different depths from one another (e.g., as measured along the direction of advancement of the TBM). Hence, such operation of the cutter assembly 120*a* may reduce load on any one of superhard cutter elements 150*a*, thereby increasing the useful life thereof.

In an embodiment, at least some of the superhard cutter elements may have a different configuration than other superhard cutter elements. For example, the superhard cutter element 151*a*' may be different from the superhard cutter elements 151*a*. In some embodiments, the superhard cutter element 150*a*' may have an at least partially convex (e.g., domed) superhard working surface 151*a*'. In an embodiment, the superhard working surface 151*a*' may include flat or conical portions blended with a generally domed portion thereof. Accordingly, the superhard working surface 151*a*' may have multiple superhard working surfaces that may engage the target material as the superhard cutter element 150*a*' moves therethrough.

In some embodiments, the superhard cutter element 150*a*' may be positioned at an uppermost portion or location of the support block 140*a*. Particularly, in an embodiment, the superhard cutter element 150*a*' may be positioned in a manner that the superhard cutter element 150*a*' is first to engage the target material, as the cutterhead of the TBM advances toward or into the target material. Therefore, the superhard cutter element 150*a*' may provide initial engagement with or cutting or ripping of the target material.

In an embodiment, the superhard cutter element 150*a*' may be positioned approximately at the longitudinal center of the support block 140*a* along the longitudinal axis 35*a*. Also, the superhard cutter element 150*a*' may be positioned approximately at a crosswise center of the support block 140*a*. In other words, the superhard cutter element 150*a*' may be positioned approximately in the center (from a top view) of the support block 140*a*. The superhard cutter element 150*a*' also may be positioned in alignment with a row of the superhard cutter elements 150*a* (e.g., a row of superhard cutter elements mounted or affixed to the support block 140*a* along surface 143*a* of the support block 140*a*).

In some embodiments, the cutter assembly 120*a* may be symmetrical about one or more axes. For example, the above description of the cutter assembly 120*a* identifies surfaces 144*a*, 145*a*, 148*a*, 149*a*, illustrated on a left end portion 155*a* of the cutter assembly 120*a*. In an embodiment, the cutter assembly 120*a* may include similar or identically configured surfaces and/or superhard cutter elements 150*a* on a symmetrical right end portion 156*a* thereof.

Figure 2A:
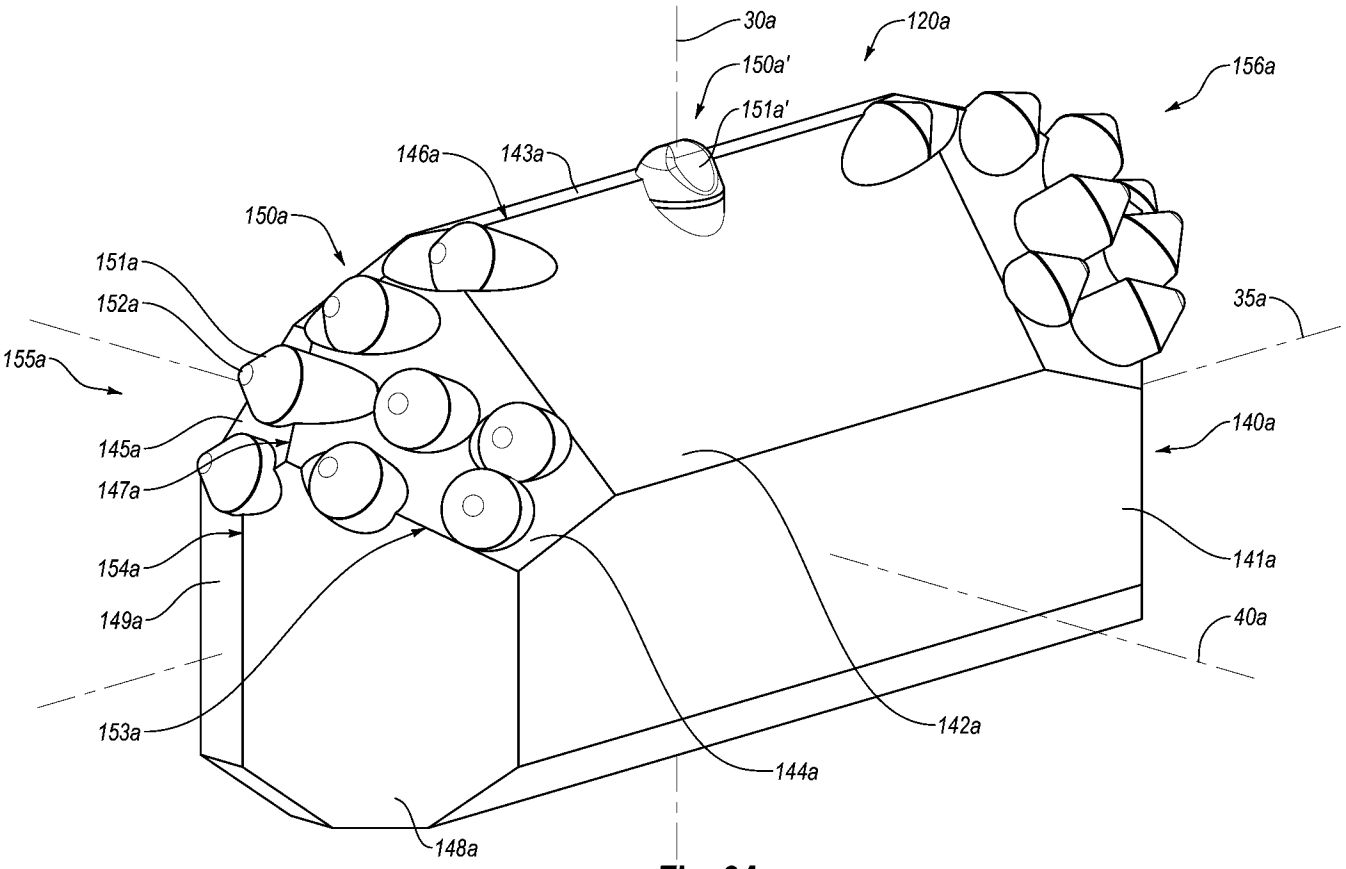
FIG. 2A is an isometric view of a cutter assembly according to an embodiment of the invention.
Figure 2B:
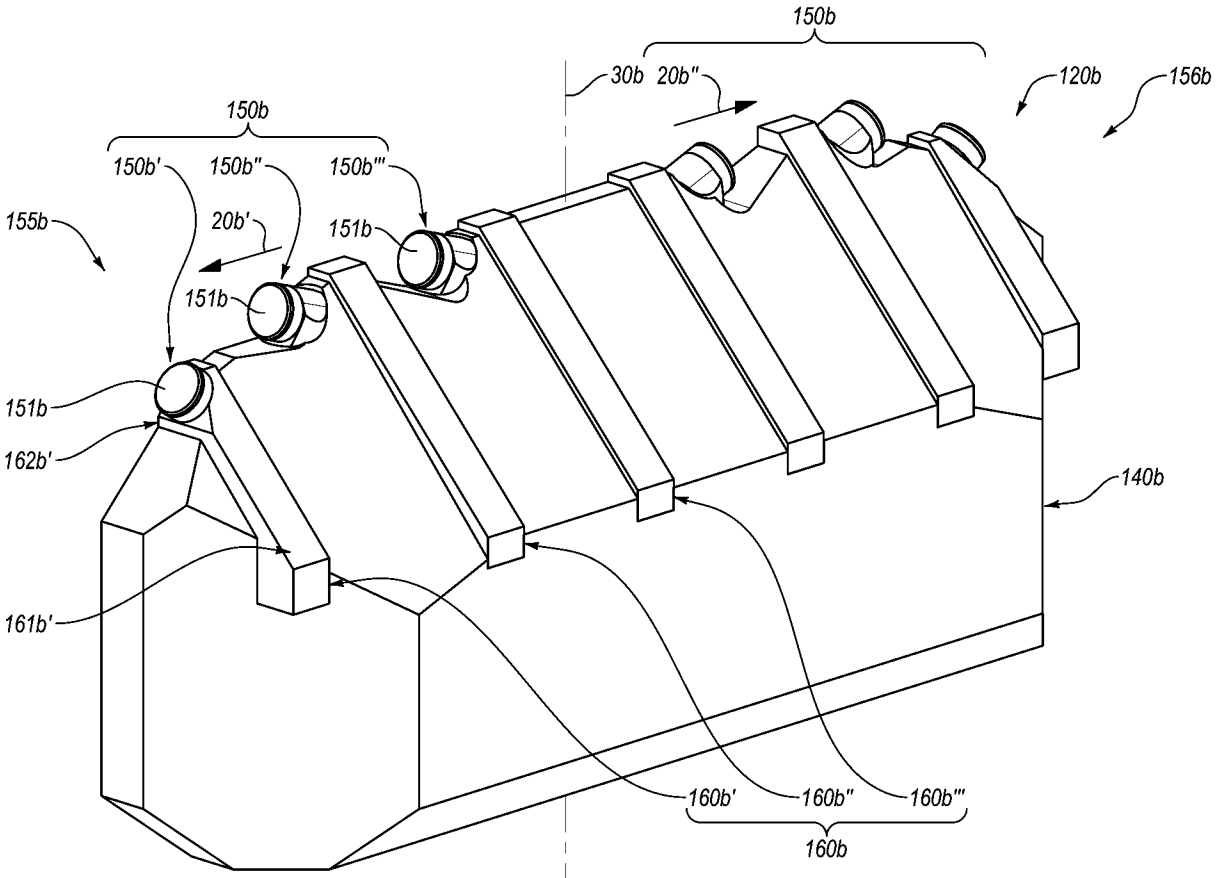
FIG. 2B is an isometric view of a cutter assembly according to an embodiment of the invention.

In another embodiment, wear pads or elements may be affixed to a support block in combination with superhard cutter elements. For example, as illustrated in FIG. 2B, a cutter assembly 120*b* may include scrapers or elongated wear elements, such as wear elements 160*b* (which may include wear elements 160*b*', 160*b*", 160*b*'"). Except as otherwise described herein, the cutter assembly 120*b* and its materials, elements, features, or components may be similar to or the same as any of the cutter assemblies 120, 120*a* (FIGS. 1A-2A) and their respective materials, elements, features, and components. For example, the cutter assembly 120*b* may include a support block 140*b*, which may have a similar or the same shape and/or size as the support block 140*a* (FIG. 2A).

The wear elements 160*b* may be positioned along any surface of the support block 140*b*. Furthermore, the wear elements 160*b* may include one or more cutting edges, which may engage the target material. In particular, the cutting edges of the wear elements 160*b* may scrape or otherwise fail and remove the target material and/or protect the support block 140*a*. The cutter assembly 120*b* also may include superhard cutter elements 150*b* (e.g., superhard cutter elements 150*b*', 150*b*", 150*b*'"), with the working surface of each of may be oriented at a non-parallel angle relative to a centerline 30*b* of the support block 140*b*. In some embodiments, the centerline 30*b* may be oriented approximately parallel to axis 10 of the TBM 100 (FIG. 1A) after the cutter assembly 120*b* is mounted on the cutterhead.

In some embodiments, the superhard cutter elements 150*b* may include superhard working surfaces 151*b*. More specifically, as described below in further detail, the superhard working surfaces 151*b* may engage the target material during use. Furthermore, the superhard working surfaces may form one or more cutting edges, which may facilitate entry of the superhard cutter elements 150*b* into the target material.

In an embodiment, one, some, or all of the working surfaces of the superhard cutter elements 150*b* may face approximately in a first cutting direction (e.g., in a cutting direction 20*b*'). Additionally or alternatively, a first group of the working surfaces of the superhard cutter elements 150*b* may face generally toward the first cutting direction 20*b*', while a second group of the working surfaces of the superhard cutter elements 150*b* may face generally toward second cutting direction 20*b*". In an embodiment, as the cutterhead rotates in the first direction (e.g., in a clockwise direction), the cutter assembly 120*b* may move in the first cutting direction 20*b*', and the first group of the superhard cutter elements 150*b* and/or wear elements 160*b* may engage and cut, rip, scrape, or otherwise fail the target material. Conversely, rotating the cutterhead in the second, opposite direction (e.g., in a counterclockwise direction), may move the cutter assembly 120*b* in the second cutting direction 20*b*", thereby engaging the second group of the superhard cutter elements 150*b* and/or wear elements 160*b* with target material.

In some embodiments, the wear elements 160*b* may have a plate-like shape and may be secured within channels or recesses in that support block 140*b*. For example, the wear elements 160*b* may have a shape of an approximately triangular plate. Furthermore, in some embodiments, the wear elements 160*b* may have one or more truncated peaks (e.g., the peak at the uppermost portion of the wear elements 160*b* may be flat or approximately planar). In other words, an otherwise sharp peak of a triangular-shaped plate may be truncated to form planar portions of the wear elements 160*b*. In an embodiment, opposing cutting sides (e.g., cutting sides 161*b*', 162*b*' of the wear elements 160*b*') may form or define the cutting edges of the wear elements 160*b* and may form an acute angle therebetween. Alternatively, the opposing cutting sides may form an obtuse angle therebetween.

The wear elements 160*b* may be brazed, fastened, press-fitted, or otherwise secured within the recesses in the support block 140*b*. In some embodiments, the wear elements 160*b* may be removably secured to and/or within that support block 140*b*, which may allow removal and/or replacement thereof. In any event, the wear elements 160*b* may be sufficiently secured within the recesses in the support block 140*b* to remain attached to the support block during operation of the cutter assembly 120*b*.

Furthermore, each of wear elements 160*b* may have a progressively decreasing size with increasing distance from the centerline 30*b* toward end portions 155*b*, 156*b*. For example, wear element 160*b*' may be the smallest of the wear elements 160*b*, while the wear elements 160*b*' may be the largest of the wear elements 160*b*. Also, cutting edges of the wear elements 160*b* may engage the target material at various depths, thereby reducing the load on a single wear element 160*b* that may operate at a greater depth of cut. In other words, as the cutter assembly 120*b* enters the target material, the wear element 160*b*' may rip or scrape the target material at a first depth, thereby reducing the amount of material engaged by wear element 160*b*". Similarly, the wear elements 160*b*' and 160*b*" may remove target material at first and second depths, respectively, thereby reducing the amount of target material engaged by the wear element 160*b*'".

The wear elements 160*b* may include any suitable material, which may vary from one embodiment to the next. For example, the wear elements 160*b* may include cemented tungsten carbide, high speed steel, tool steel (e.g., A2, D2, etc.), case hardened steel, and the like. For example, steel wear elements may have hardness in one or more of the following ranges: between about 32 HRC and 45 HRC; between about 40 HRC and 55 HRC; between about 50 HRC and 60 HRC; or between about 58 HRC and 64 HRC. In some embodiments, hardness of steel cutter elements may be greater than 64 HRC or less than 32 HRC. Also, the wear elements 160*b* may be coated, and the coating may reduce friction of the wear elements 160*b* relative to the target material and/or may improve wear resistant characteristics of the wear elements 160*b*. For example, steel wear elements may be hardfaced with a tungsten carbide material.

As mentioned above, the cutter assembly 120*b* may include superhard cutter elements 150*b*. In some embodiments, at least one of the superhard cutter elements 150*b* may be secured to at least one of the wear elements 160*b*. For example, the superhard cutter elements 150*b*' may be secured to and/or within the wear element 160*b*'. In particular, the superhard cutter elements 150*b*' may be secured near or at an apex or the flat uppermost portion of the wear element 160*b*'. In an embodiment, the superhard cutter elements 150*b*' may protrude above the uppermost portion of the wear element 160*b*'. For example, the superhard cutter elements 150*b*' may include a polycrystalline diamond compact (described below in further detail), while the wear element 160*b*' may include tungsten carbide (e.g., cobalt-cemented tungsten carbide). Consequently, the superhard cutter elements 150*b*' may be sized and configured to protect the apex or an otherwise uppermost portion of the wear element 160*b*' from wear, damage, breakage, or combinations thereof. That is, the superhard cutter elements 150*b*' may engage the target material before the wear element 160*b*' engages the target material, and may clear at least some target material from the path of the wear elements 160*b*.

Additionally or alternatively, the cutter assembly 120*b* may include one or more superhard cutter elements 150*b* positioned to precede one or more of the wear elements 160*b* during cutting (e.g., with respect to a cutting direction, such as one or more of the cutting directions 20*b*', 20*b*"). For example, the superhard cutter element 150*b*" may be positioned to precede at least one of the wear elements 160*b*". In some embodiments, the superhard cutter element 150*b*" may be attached to the support block 140*b*. In any event, as the cutter assembly 120*b* moves (e.g., in the cutting direction 20*b*'), the superhard cutter elements 150*b*" may engage the target material before engagement thereof with the wear element 160*b*". Consequently, the superhard cutter element 150*b*" may cut, rip, or otherwise fail and remove at least a portion of the target material from the path of the wear element 160*b*", which may increase the useful life of the wear elements 160*b* and/or of the cutter assembly 120*b*.

As mentioned above, the superhard cutter elements 150*b* may include superhard working surfaces 151*b*. Such superhard working surfaces 151*b* may have any suitable shape, size, and configuration, which may vary from one embodiment to the next. In the embodiment illustrated in FIG. 2B, each of the superhard cutter elements 150*b* include a substantially planar superhard working surface 151*b*. It should be appreciated, however, that any of the superhard cutter elements described herein may be incorporated into any of the cutter assemblies disclosed herein.

Furthermore, in an embodiment, the superhard working surfaces 151*b* may have a chamfer or a radius about a periphery thereof. The chamfer or radius may reduce or eliminate chipping or cracking of the superhard working surfaces 151*b*, during the operation of the cutter assembly 120*b*. Alternatively, the periphery of the working surfaces may be defined by a sharp edge.

Figure 2C:
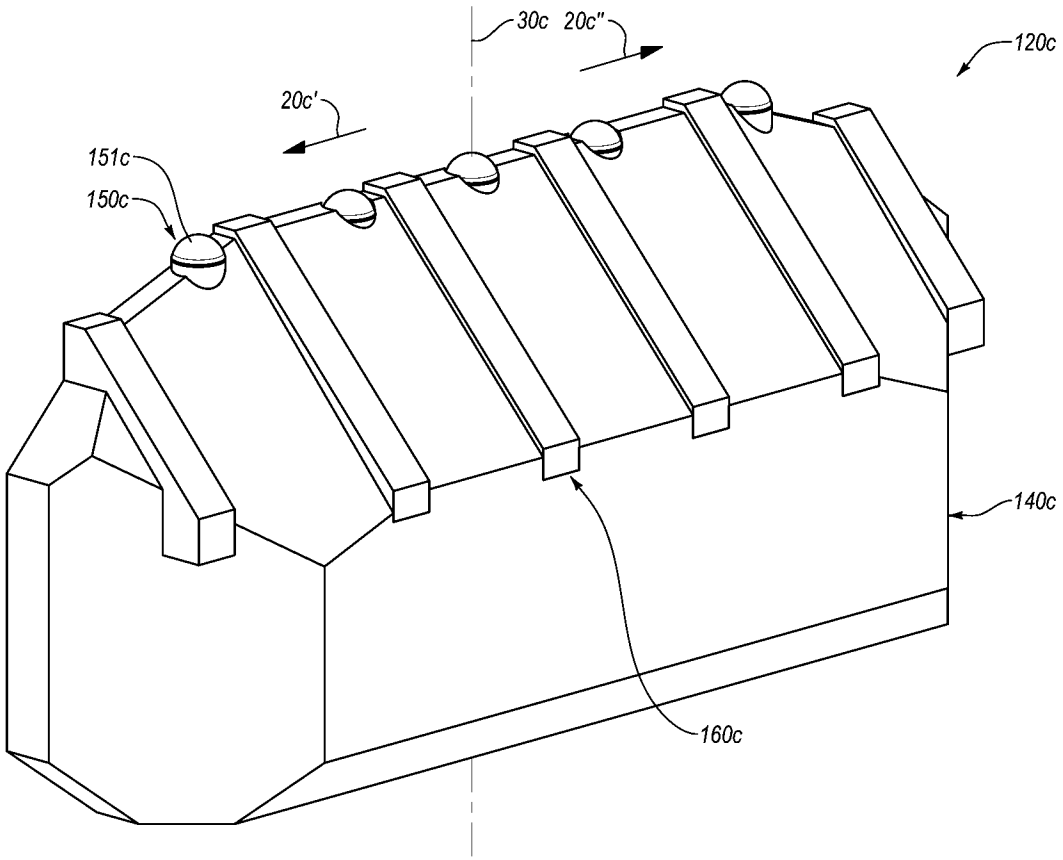
FIG. 2C is an isometric view of a cutter assembly according to an embodiment of the invention.

As shown in FIG. 2C, embodiments also may include a cutter assembly 120*c* that incorporates superhard cutter elements 150*c* (not all labeled in FIG. 2C) with domed superhard working surfaces 151*c*. Except as otherwise described herein, the cutter assembly 120*c* and its materials, elements, features, or components may be similar to or the same as any of the cutter assemblies 120, 120*a*, 120*b* (FIGS. 1A-2B) and their respective materials, elements, features, and components.

For example, the cutter assembly 120*c* may include a support block 140*c* that may secure the superhard cutter elements 150*c* as well as one or more wear elements 160*c* (not all labeled in FIG. 2C). Specifically, in an embodiment, the support block 140*c* and/or the wear elements 160*c* may be similar to or the same as the support block 140*b* and the wear elements 160*b* (FIG. 2B), respectively. Also, in some embodiments, center axis of at least one of the superhard cutter elements 150*c* may have an approximately parallel orientation relative to a centerline 30*c* of the cutter assembly 120*c*. In other words, the superhard working surfaces 151*c* may generally face in a direction oriented along centerline 30*c* (e.g., the superhard working surfaces 151*c* may be oriented relative to the support block such that during movement in first and/or second cutting directions 20*c*', 20*c*" the superhard working surfaces 151*c* may engage target material). As such, the semispherical shape of the superhard working surfaces 151*c* may facilitate a gradual or limited engagement of the superhard working surfaces 151*c* with the target material, thereby reducing or eliminating chipping or cracking that may otherwise result during impact or engagement of the superhard working surfaces 151*c* with the target material.

In one or more embodiments, the uppermost portion of each of the superhard cutter elements 150*c* may be located at approximately the same height (as measured from any surface (e.g., an imaginary surface) that is perpendicular to the centerline 30*c*). Accordingly, some or all of the superhard cutter elements 150*c* may engage the target material substantially simultaneously with one another, depending on the rate at which a TBM is moving forward, the rate of rotation of such TBM, and the relation of the support block 140*c* with respect to the TBM. Furthermore, similar to the cutter assembly 120*b* (FIG. 2B), at least one of the superhard cutter elements 150*c* may be positioned to precede one or more wear elements 160*c*. For example, the superhard cutter elements 150*c* may be located to precede with respect a first or second cutting direction (e.g., cutting directions 20*c*', 20*c*"). In such embodiments, the superhard cutter elements 150*c* may protect the uppermost portion of the wear elements 160*c* (e.g., truncated apexes of the wear elements 160*c*) from impact with the target material, which may extend the useful life of the wear elements 160*c* and/or the cutter assembly 120*c*.

Figure 3A:
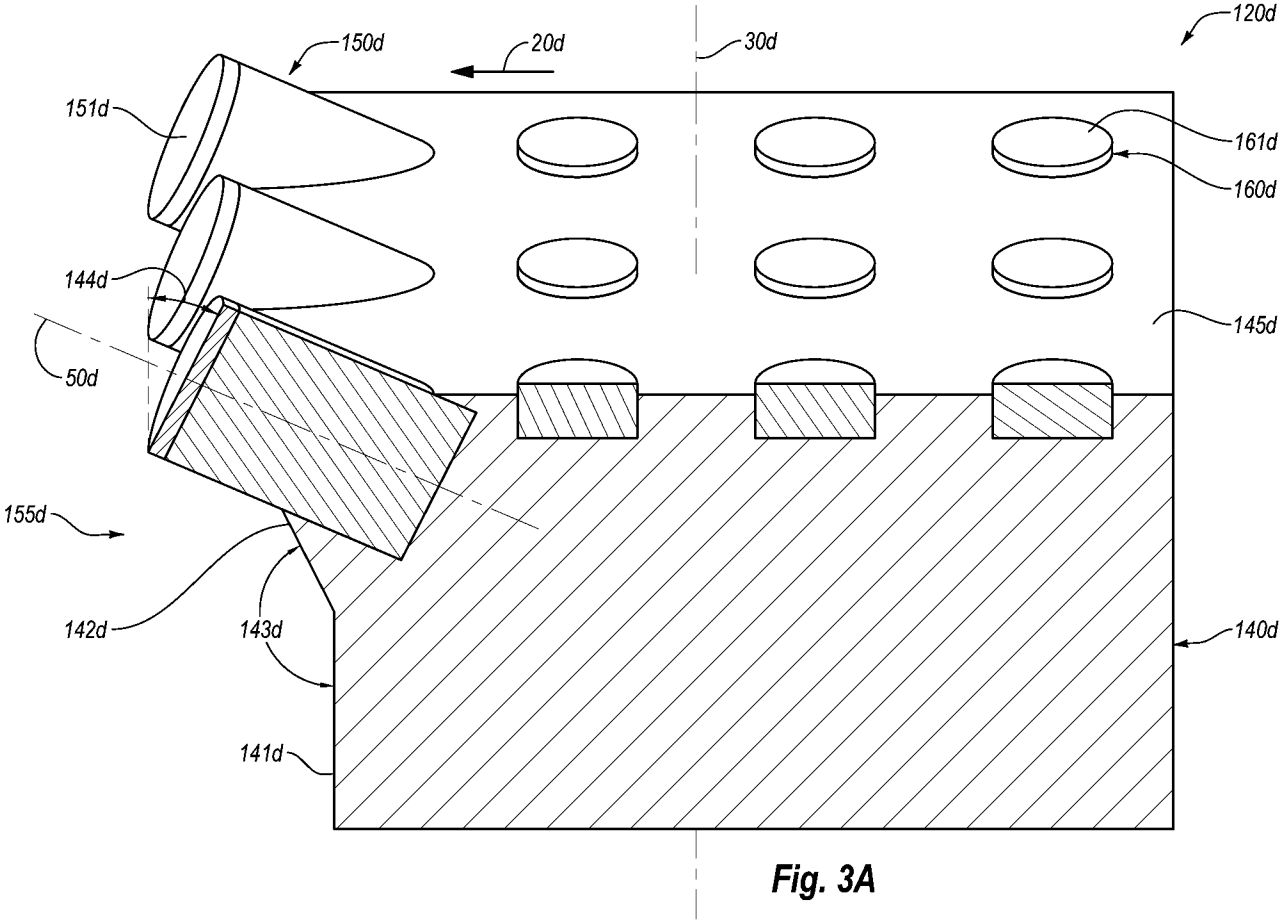
FIG. 3A is an isometric cutaway view of a cutter assembly according to an embodiment of the invention.

It should be appreciated that at least some cutter assemblies may be configured to cut, rip, scrape, or otherwise fail the target material when engaging the target material with two or more regions, end portions, surfaces of a support block, or combinations thereof. Particularly, such cutter assemblies may fail and/or remove the target material as the cutterhead rotates. At least one embodiment includes a cutter assembly configured to cut, rip, scrape, or otherwise fail the target material when target material engages one end portion, region or surface of the support block. For example, FIG. 3A illustrates a cutter assembly 120*d* configured to cut as cutter assembly 120*d* moves against the target material (e.g., in direction 20*d*) such that the cutter elements engage the target material. For example, the cutter assembly 120*d* may include superhard cutter elements 150*d* secured to a support block 140*d*, such that superhard working surfaces 151*d* of the superhard cutter elements 150*d* generally face in or along direction 20*d*. Except as otherwise described herein, the cutter assembly 120*d* and its materials, elements, features, or components may be similar to or the same as any of the cutter assemblies 120, 120*a*, 120*b*, 120*c* (FIGS. 1A-2C) and their respective materials, elements, features, and components.

In an embodiment, the support block 140*d* may have an approximately cuboid shape. For example, one or more sides of the support block 140*d* may facilitate mounting or securing the cutter assembly 120*d* to the cutterhead. Also, in some embodiments, a leading side 155*d* of the support block 140*d* (e.g., the side generally facing in direction 20*d*) may include one or more features configured to provide relief during engagement of the superhard cutter elements 150*d* with the target material. For example, the leading side 155*d* of the support block 140*d* may include a substantially vertical portion 141*d*, which may be substantially parallel to a centerline 30*d* of the cutter assembly 120*d*. The leading side also may include an angled portion 142*d*, which together with the vertical portion 141*d* may provide cutting relief for the superhard cutter elements 150*d*. More specifically, the angled portion 142*d* and the vertical portion 141*d* may form an obtuse angle 143*d* therebetween. For example, the obtuse angle 143*d* may be greater than 90 degrees, about 100 degrees to about 160 degrees, about 110 degrees to about 140 degrees, or other suitable obtuse angle. In any event, as the superhard working surfaces 151*d* engage and excavate the target material, the excavated material may enter or fall toward and move along the angled portion 142*d* toward the vertical portion 141*d*.

In some embodiments, the superhard cutter elements 150*d* may be oriented at an acute angle relative to the centerline 30*b*. Furthermore, as mentioned above, the superhard cutter elements 150*d* may include a substantially planar working surfaces 151*d*. Consequently, in an embodiment, the superhard working surfaces 151*d* may have an acute back rake angle 144*d* (as measured relative to an imaginary line parallel with the centerline 30*d* of the cutter assembly 120*d*), such that as the upper portions of the superhard working surfaces 151*d* engage the target material and fails and/or excavates the target material, the excavated material may move along the superhard working surfaces 151*d* and away from the uppermost portions thereof. In some embodiments, the upper portions of the superhard working surfaces 151*d* may experience the higher load (as compared with other portions of the 151*d*). The back rake angle 144*d*, however, may reduce the load experienced by the uppermost portions of the superhard working surfaces 151*d* by channeling the excavated material away therefrom, which may reduce or eliminate clogging or buildup of the excavated material on the uppermost portions of the superhard working surfaces 151*d*.

In an embodiment, the cutter assembly 120*d* may optionally include one or more wear elements 160*d* protruding outward from a top surface 145*d* of the support block 140*d*. The wear elements 160*d* may facilitate failing the target material and/or scraping the failed material toward one or more openings in the surface of the cutterhead. For example, as the cutter assembly 120*d* moves in direction 20*d*, working surfaces 161*d* of the wear elements 160*d* may engage the target material and/or the failed material to urge the target and/or failed material toward an opening in the cutterhead. The wear elements 160*d* may also protect top surface 145*d* of the support block 140*d* from excessive wear from contact with the target material.

In some embodiments, each of the wear elements 160*d* may include a substantially planar working surface 161*d*. Also, optionally, the working surfaces 161*d* of the wear elements 160*d* may be oriented in a direction substantially parallel relative to the centerline 30*d* of the cutter assembly 120*d*. Optionally, the working surfaces 161*d* may be substantially parallel to the top surface 145*d* of the support block 140*d*. Moreover, as mentioned above, in some embodiments, when the cutter assembly 120*d* is mounted to the cutterhead, the centerline 30*d* may be oriented approximately parallel to axis 10 of TBM (FIG. 1A) of the cutterhead. Accordingly, in at least one embodiment, the working surfaces 161*d* may be oriented approximately parallel to the front surface 111 of the cutterhead 110 shown in FIG. 1A.

As described above, the superhard cutter elements 150*d* of the cutter assembly 120*d* may exhibit the back rake angle 144*d*, which may facilitate failing the target material as the cutter assembly 120*d* engages the target material. The back rake angle 144*d* may vary from one embodiment to the next. For example, in the embodiment illustrated in FIG. 3A, the superhard working surfaces 151*d* of the superhard cutter elements 150*d* may be approximately perpendicular to a center axis of the respective superhard cutter elements 150*d* (e.g., center axis 50*d*). Accordingly, the back rake angle 144*d* may be defined or dictated by the orientation of the superhard cutter elements 150*d* relative to the centerline 30*d*. Generally, the back rake angle may be in one or more of the following ranges: between about 1° and about 5°; between about 3° and about 10°; between about 7° and about 20°; between about 15° and 30°; or between about 25° and 45°. In some embodiments, the back rake angle may be less than 1° or greater than 45°.

Figure 3B:
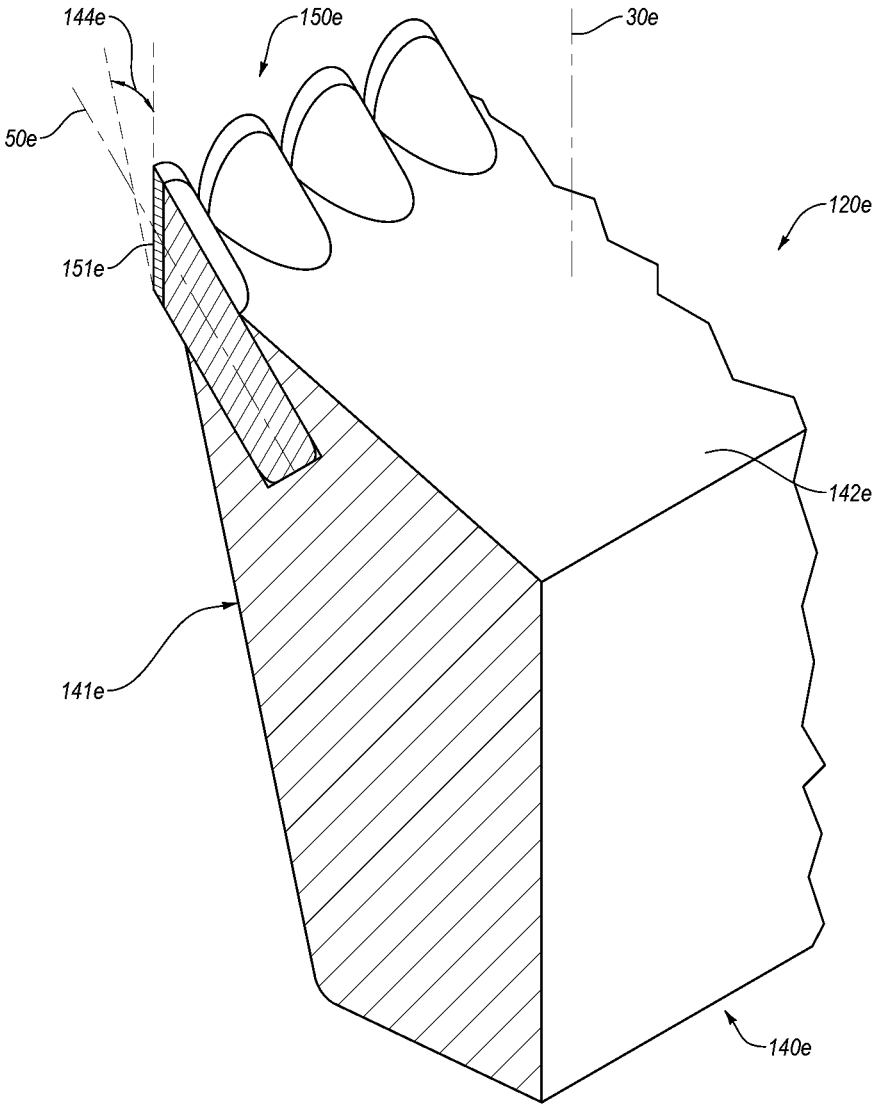
FIG. 3B is an isometric cutaway view of a cutter assembly according to an embodiment of the invention.

Additionally or alternatively, a cutter assembly may include superhard cutter elements that have slanted superhard working surfaces oriented at a non-perpendicular angle relative to the center axes of the respective superhard cutter elements, which may produce a suitable back rake angle. For example, FIG. 3B illustrates a cutter assembly 120*e* that may include superhard cutter elements 150*e* (not all labeled in FIG. 3B) with corresponding superhard working surfaces 151*e* oriented at a non-perpendicular angle relative to the center axis 50*e* thereof. Except as otherwise described herein, the cutter assembly 120*e* and its materials, elements, features, or components may be similar to or the same as any of the cutter assemblies 120, 120*a*, 120*b*, 120*c*, 120*d* (FIGS. 1A-3A) and their respective materials, elements, features, and components.

In some embodiments, the superhard working surfaces 151*e* may have a back rake angle 144*e* that may be in one or more of the same ranges as the back rake angle 144*d* (FIG. 3A). Moreover, slanting the superhard working surfaces 151*e* relative to the center axis of the superhard cutter elements 150*e* may increase the surface area of the superhard working surfaces 151*e*, thereby providing a greater area that may contact, disrupt, or otherwise fail the target material. In additional or alternative embodiments, the leading surface 141*e* of the support block 140*e* may be oriented at a non-parallel angle relative to the centerline 30*e*. For example, the leading surface 141*e* may form an acute angle with a top surface 142*e*.

In any case, the failed material may move along the superhard working surface 151*e* and onto the leading surface 141*e*. As new or additional failed material moves across the leading surface 141*e*, material previously present at or near the leading surface 141*e* may be pushed away (e.g., into an opening in the front surface of the cutterhead) by the new material. Accordingly, the cutter assembly 120*e* may fail the target material and channel the failed and into one or more openings in the front surface of the cutterhead.

Figure 3C:
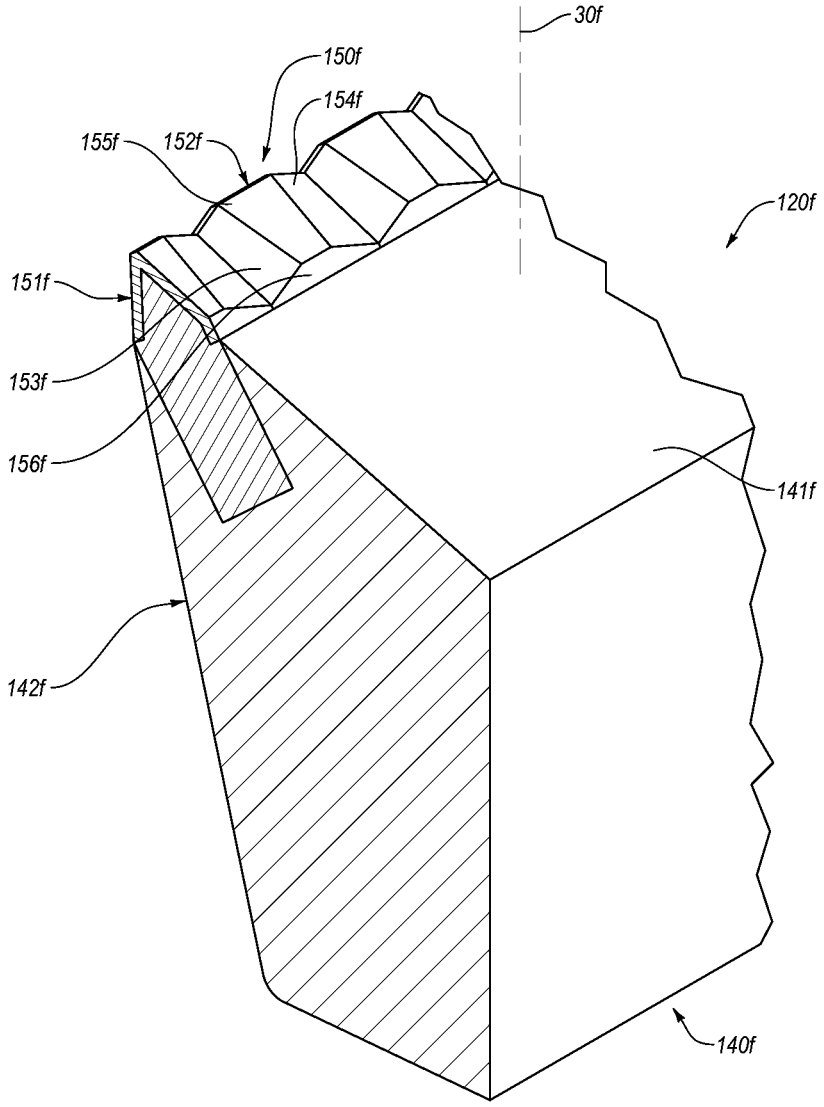
FIG. 3C is an isometric cutaway view of a cutter assembly according to an embodiment of the invention.

In some embodiments, a cutter assembly also may include superhard cutter elements that have non-cylindrical geometries. For example, FIG. 3C illustrates a cutter assembly 120*f* that may include superhard cutter elements 150*f* (not all labeled in FIG. 3C) secured or bonded to support block 140*f*. Except as otherwise described herein, the cutter assembly 120*f* and its materials, elements, features, or components may be similar to or the same as any of the cutter assemblies 120, 120*a*, 120*b*, 120*c*, 120*d*, 120*e* (FIGS. 1A-3B) and their respective materials, elements, features, and components. In an embodiment, the superhard cutter elements 150*f* may include superhard working surfaces 151*f* that have corresponding multifaceted cutting edges 152*f*. More specifically, the cutting edges 152*f* may be formed by first and second side bevels 153*f*, 154*f* and a horizontal top portion 155*f* of the superhard cutter elements 150*f*. The horizontal portion 155*f* may be positioned between and adjoined by the two side bevels 153*f*, 154*f*.

In an embodiment, the top portions 155*f* may be approximately parallel with a top surface 141*f* of the support block 140*f*, which, in turn, may be approximately perpendicular to a centerline 30*f*. Alternatively, the top portions 155*f* may form an obtuse angle with the top surface 141*f*, thereby providing a relief for the failed material between the cutting edges 152*f* and the top surface 141*f*. In any event, in at least one embodiment, the top portions 155*f* may protrude above the top surface 141*f* of the support block 140*f*.

In some embodiments, the side bevels 153*f*, 154*f* may be relieved relative to the cutting edges 152*f* formed thereby. In other words, as the cutter assembly 120*f* moves and engages the target material and the cutting edges 152*f* engage the target material, the side bevels 153*f* and the 154*f* are oriented in a manner to reduce or minimize contact with the target material and to reduce drag forces experienced by the cutter assembly 120*f*. Additionally, the superhard cutter elements 150*f* may include a back bevel 156*f*, which may provide further relief and space for the failed material.

As mentioned above, in some embodiments, the superhard cutter elements of the cutter assembly may have an acute back rake angle, which may facilitate failing and/or removing or excavating target material. Alternatively, however, at least some of the superhard cutter elements of the cutter assembly may have no back rake angle. For example, the superhard working surfaces 151*f* of the superhard cutter elements 150*f* may be oriented substantially parallel to the centerline 30*f* Furthermore, as the cutter assembly 120*f* fails the target material, the excavated material formed thereby may move along a leading side 142*f* of the support block 140*f* and toward or into one or more openings in the front surface of the cutterhead.

Figure 3D:
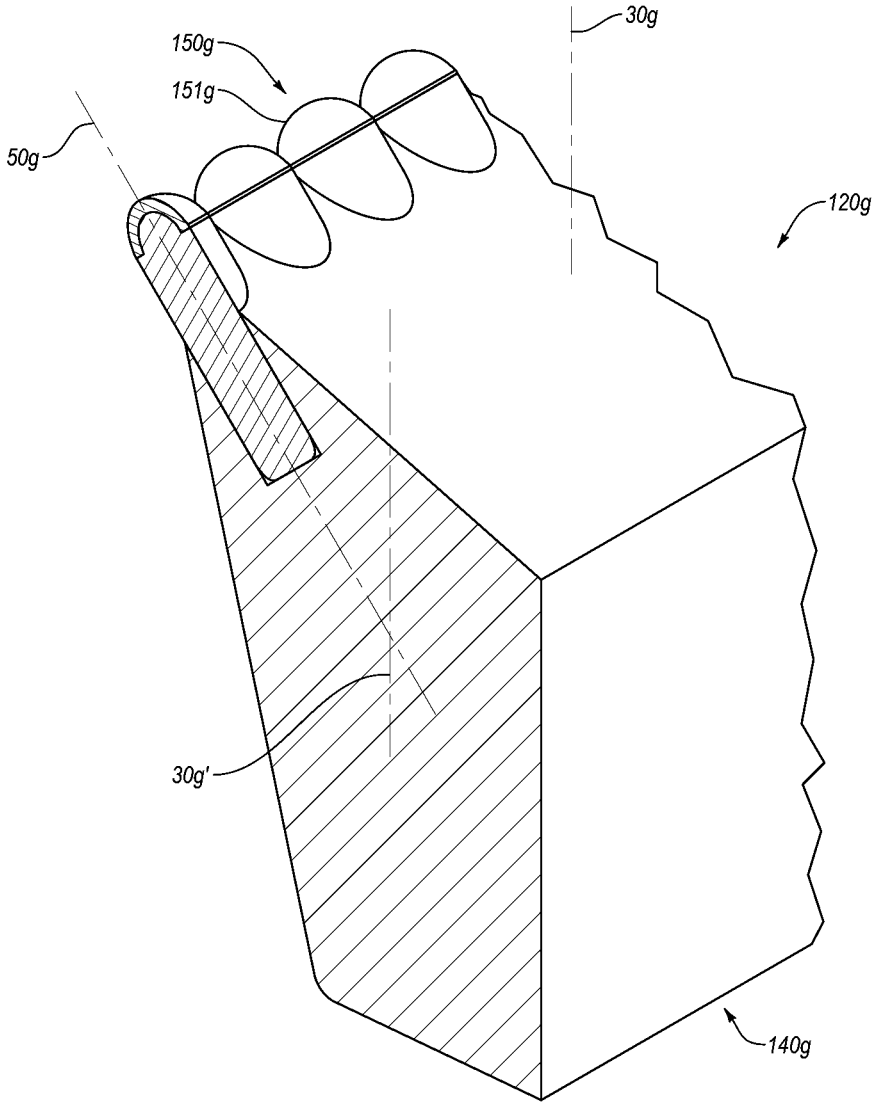
FIG. 3D is an isometric cutaway view of a cutter assembly according to an embodiment of the invention.

As described above, the superhard cutter elements may have any number of suitable configurations. FIG. 3D illustrates yet another embodiment of a cutter assembly 120*g*. Except as otherwise described herein, the cutter assembly 120*g* and its materials, elements, features, or components may be similar to or the same as any of the cutter assemblies 120, 120*a*, 120*b*, 120*c*, 120*d*, 120*e*, 120*f* (FIGS. 1A-3C) and their respective materials, elements, features, and components. The cutter assembly 120*g* may include domed (e.g., semispherical or other convex geometry) superhard cutter elements 150*g* (not all labeled in FIG. 3D) secured to and/or within the support block 140*g*. For example, the superhard cutter elements 150*g* may have a selected angular orientation relative to a centerline 30*g* or a reference line that is substantially parallel to the centerline 30*g* (e.g., relative to reference line 30*g*'). In particular, for example, center axis 50*g* of the superhard cutter element 150*g* may be oriented at a non-parallel angle relative to the reference line 30*g'*.

The superhard cutter elements 150*g* may include domed superhard working surfaces 151*g*, which may engage the target material. For example, the domed superhard working surfaces 151*g* may operate without chipping or cracking when impacting or engaging hard target material (e.g., rocks). In some embodiments, the domed superhard working surfaces 151*g* may cause the target material to crack, fracture, or otherwise fail. Moreover, the cutterhead may include cutter assemblies and/or superhard cutter elements that may engage the target material after the superhard cutter elements 150*g*. For example, additional cutter assemblies (which may be mounted on the cutterhead of the TBM) as well as superhard cutter elements may scrape or otherwise remove the failed material, producing the excavated material that may be removed by the TBM (FIG. 1A).

Figure 3E:
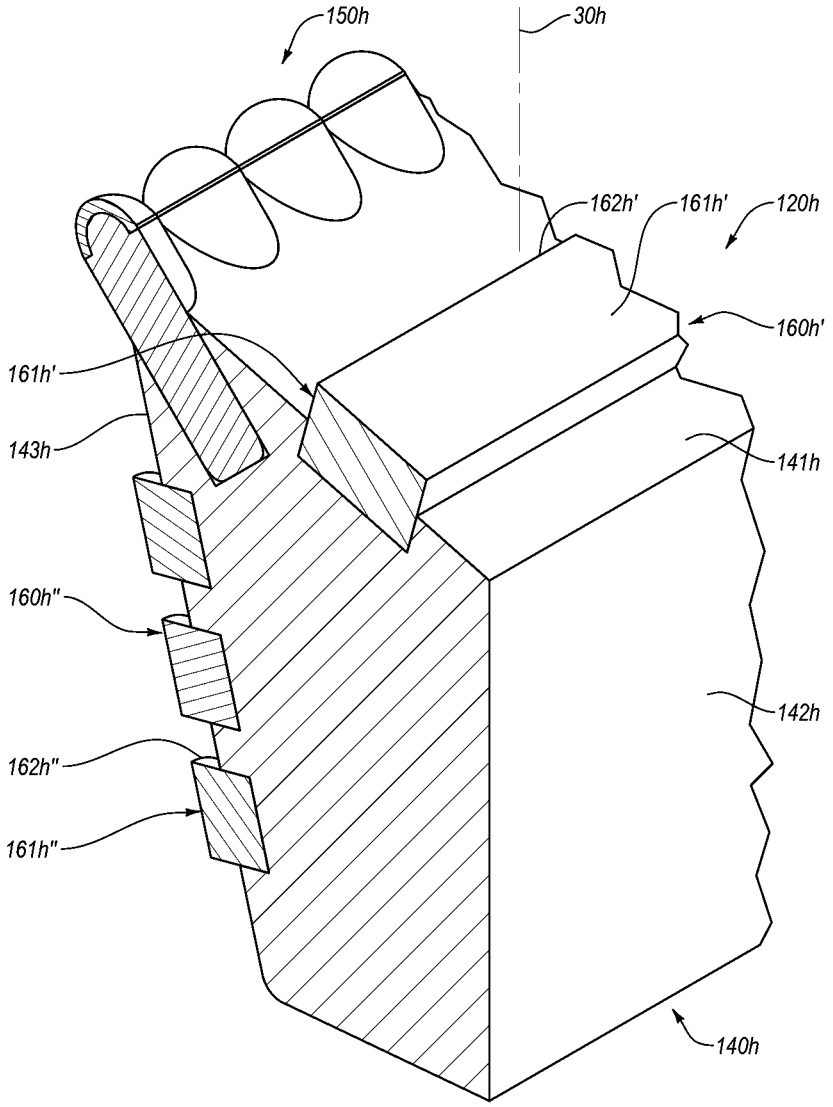
FIG. 3E is an isometric cutaway view of a cutter assembly according to an embodiment of the invention.

As described above, in addition to the superhard cutter elements that face generally in a selected direction, a cutter assembly may include superhard cutter elements positioned at any selected orientation. Moreover, in some embodiments, a cutter assembly may include one or more superhard cutter elements on a leading surface thereof. FIG. 3E illustrates an embodiment of a cutter assembly 120*h*. Except as otherwise described herein, the cutter assembly 120*h* and its materials, elements, features, or components may be similar to or the same as any of the cutter assemblies 120, 120*a*, 120*b*, 120*c*, 120*d*, 120*e*, 120*f*, 120*g* (FIGS. 1A-3D) and their respective materials, elements, features, and components.

For example, the cutter assembly 120*h* may include superhard cutter elements 150*h* (not all labeled in FIG. 3E) secured to a support block 140*h*, where the support block 140*h* and/or the superhard cutter elements 150*h* may be similar to or the same as the support block 140*g* and superhard cutter elements 150*g* (FIG. 3D), respectively. It should be appreciated, however, that any of the superhard cutter elements may be used in any of the cutter assemblies described herein. For example, superhard cutter elements 150*f* (FIG. 3C) may be used in the cutter assembly 120*h* in addition to or in lieu of the superhard cutter elements 150*h*. In any event, the cutter assembly 120*h* may optionally include an elongated wear element 160*h*', which may span across at least a portion of the support block 140*h*.

In an embodiment, the wear element 160*h*' may be positioned on and/or in a top surface 141*h* of the support block 140*h*. Furthermore, the top surface of the wear element 160*h*' may be substantially planar and, in some embodiments, may be approximately parallel to the top surface 141*h* of the support block 140*h*. In some embodiments, the top surface 141*h* may form a non-perpendicular angle with a back surface 142*h* of the support block 140*h*, which may be approximately parallel with a centerline 30*h*. For example, the top surface 141*h* and the back surface 142*h* may form an obtuse angle therebetween.

Moreover, in some embodiments, the back surface 142*h* and a leading side 143*h* may have a non-parallel orientation relative to each other. For example, the leading side 143*h* and the back surface 142*h* may form an acute angle. In other words, the leading side 143*h* may form an acute angle with the centerline 30*h*. In additional or alternative embodiments, the leading side 143 also may form an acute angle with the top surface 141*h*. As such, the excavated material may have clearance to be pushed along the leading side 143*h* and/or along the top surface 141*h*.

Particularly, in an embodiment, the wear element 160*h*' may have a continuous working surface that may extend along the top surface 141*h* a distance less than, equal to, or exceeding the distance spanned by the superhard cutter elements 150*h*. For example, the working surface of the wear element 160*h*' may extend across the support block 140*h* to approximately the same lateral extent at least four of the superhard cutter elements 150*h*. As such, the target material ripped or at least partially failed by the superhard cutter elements 150*h* may be scraped and removed or excavated by scraping action of the wear element 160*h*'. In other words, the superhard cutter elements 150*h* may rip, disrupt, or otherwise loosen the target material, while the wear element 160*h*' may remove or excavate the loosened material.

The cutter assembly 120*h* also may optionally include wear elements 160*h*" (not all labeled in FIG. 3E), which may be positioned on the leading side of the support block 140*h*. As the cutter assembly 120*h* moves in the cutting direction, the wear elements 160*h*" may engage the target material and may cut, rip, scrape, or otherwise disrupt and/or remove the target material. Moreover, the wear elements 160*h*" may protect the leading side 143*h* of the support block 140*h* from damage, abrasion, or wear that may otherwise result from contact with the target material or with the excavated material during operation of the cutter assembly 120*h*.

In some embodiments, the wear elements 160*h*" may be substantially cylindrical (e.g., the wear elements 160*h*" may be similar to or the same as the wear elements 160*d* (FIG. 3A). In an embodiment, however, the wear elements 160*h*" may span laterally across at least a portion of the leading side of the support block 140*h*. For example, the wear elements 160*h*" may span the entire width of the support block 140*h*. Also, in some embodiments, the wear elements 160*h*" may extend over the same or similar distance as the wear element 160*h'*.

The wear element 160*h*' and/or wear elements 160*h*" may be secured in corresponding recesses in the support block 140*h*. In some embodiments, the recesses may form continuous through-channels to which the wear element 160*h*' and/or wear elements 160*h*" may be secured (e.g., by brazing, press-fitting, mechanical fastening, etc.). Specifically, the wear element 160*h*' and/or the wear elements 160*h*" may be secured in the same or similar manner as the wear elements 160*b* (FIG. 2B), as described above. Also, in one or more embodiments, the wear element 160*h*' and/or the wear elements 160*h*" may include the same or similar material as the wear elements 160*b* (FIG. 2B).

In some embodiments, the wear elements 160*h*' and 160" may have sharp corners, including edges 162*h*', 162*h*", which may be at least partially formed by working surfaces 161*h*', 161*h*" respectively. This disclosure, however, is not so limited. In an embodiment, the cutting edges 162*h*', 162*h*" may include a chamfer or a radius that may span a portion or the entire periphery of the respective working surface of the 161*h*', 161*h"*.

Figure 3F:
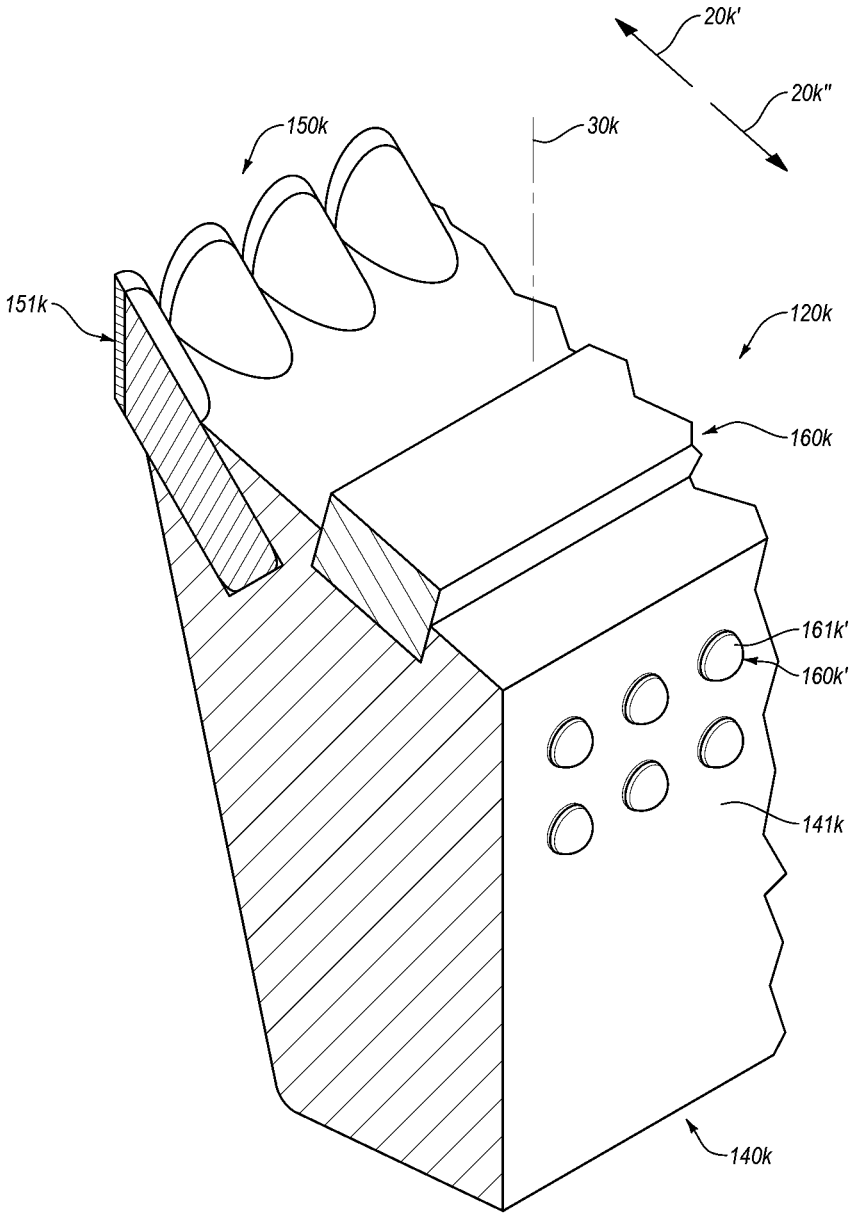
FIG. 3F is an isometric cutaway view of a cutter assembly according to an embodiment of the invention.

As mentioned above, any of the superhard cutter elements described herein and combinations thereof may be included in any of the cutter assemblies. FIG. 3F illustrates a cutter assembly 120*k*, which may include superhard cutter elements 150*k* (not all labeled in FIG. 3F) that may have slanted superhard working surfaces 151*k* and a cutter element 160*k* secured to a support block 140*k*. Except as otherwise described herein, the cutter assembly 120*k* and its materials, elements, features, or components may be similar to or the same as any of the cutter assemblies 120, 120*a*, 120*b*, 120*c*, 120*d*, 120*e*, 120*f*, 120*g*, 120*h* (FIGS. 1A-3E) and their respective materials, elements, features, and components. For example, the superhard cutter elements 150*k* may be similar to or the same as superhard cutter elements 150*e* (FIG. 3B), and the cutter element 160*k* may be similar to or the same as the wear element 160*h*' (FIG. 3E).

In one or more embodiments, the cutter assembly 120*k* may include one or more superhard wear elements positioned on a back surface 141*k* (i.e., opposite to the leading side) thereof. For example, the cutter assembly 120*k* may include superhard wear elements 160*k*' (not all labeled in FIG. 3F) positioned on the back surface 141*k*. In one example, the superhard wear elements 160*k*' may have domed (e.g., semispherical) superhard working surfaces 161*k*' that may protect back surface 141*k*. Moreover, the superhard wear elements 160*k*' may shield the back surface 141*k* from damage, abrasion, or wear during operation of the cutter assembly 120*k*.

In an embodiment, a longitudinal axis of the superhard wear elements 160*k*' may be oriented approximately perpendicular to a centerline 30*k* of the cutter assembly 120*k*. Additionally, the superhard wear elements 160*k*' may be arranged in any number of suitable configurations, which may vary from one embodiment to the next. In at least one embodiment, the superhard wear elements 160*k*' may be arranged in multiple rows and aligned columns (e.g., two rows and three columns, as shown in FIG. 3F). In another embodiment, the superhard wear elements 160*k*' may be arranged in offset rows, such that superhard wear elements 160*k*' in one row may be misaligned from superhard wear elements 160*k*' in an adjacent row.

As described above, the cutterhead of the TBM may move in a clockwise or counterclockwise direction, thereby moving the cutter assembly 120*k* in a first direction 20*k*' or in a second direction 20*k*". As such, when the cutter assembly 120*k* moves in the first direction 20*k*', the superhard cutter elements 150*k* may engage, cut, rip, or otherwise fail the target material. Optionally, the cutter assembly 120*k* may engage, cut, rip, or otherwise fail the target material in both the first and second directions 20*k*', 20*k*". Furthermore, the superhard wear elements 160*k*' may shield or protect the back surface 141*k* of the support block 140*k* during operation of the cutter assembly 120.

Figure 3G:
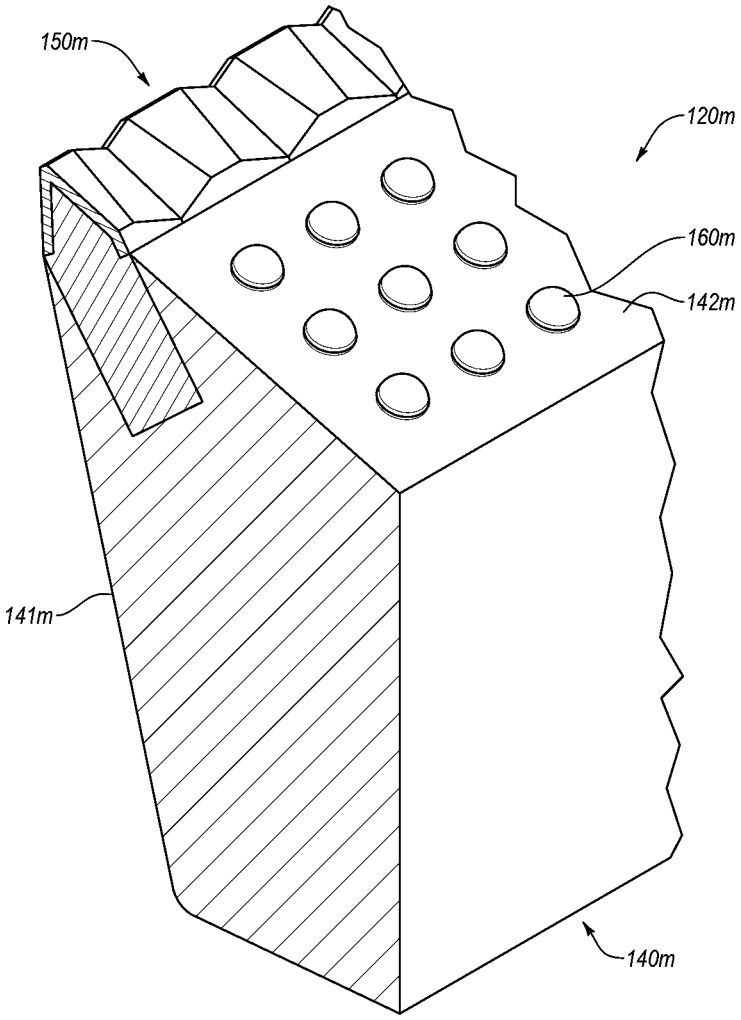
FIG. 3G is an isometric cutaway view of a cutter assembly according to an embodiment of the invention.

FIG. 3G illustrates another embodiment of a cutter assembly 120*m*, which may include multiple superhard cutter elements on the top side of the support block. In particular, the cutter assembly 120*m* may include superhard cutter elements 150*m* (not all labeled in FIG. 3G) and superhard wear elements 160*m* secured to a support block 140*m*. The superhard cutter elements 150*m* may be mounted on or near a leading surface 141*m* of the support block 140*m*, while the superhard wear elements 160*m* (not all labeled in FIG. 3G) may be mounted on a top surface 142*m* of the support block 140*m*. Except as otherwise described herein, the cutter assembly 120*m* and its materials, elements, features, or components may be similar to or the same as any of the cutter assemblies 120, 120*a*, 120*b*, 120*c*, 120*d*, 120*e*, 120*f*, 120*g*, 120*h*, 120*k* (FIGS. 1A-3F) and their respective materials, elements, features, and components. For example, the superhard cutter elements 150*m* may be similar to or the same as the superhard cutter elements 150*f* (FIG. 3C) and the superhard wear elements 160*m* may be similar to or the same as the superhard wear elements 160*k*' (FIG. 3F).

As described above, in some embodiments, the leading surface 141*m* and the top surface 142*m* may form an acute angle therebetween. Moreover, in an embodiment, a center axis of the superhard wear elements 160*m* may be aligned approximately perpendicular to the top surface 142*m*. In any event, the superhard wear elements 160*m* may protect the top surface 142*m* during operation of the cutter assembly, which may increase useful life of the cutter assembly 120*m*.

Figure 4A:
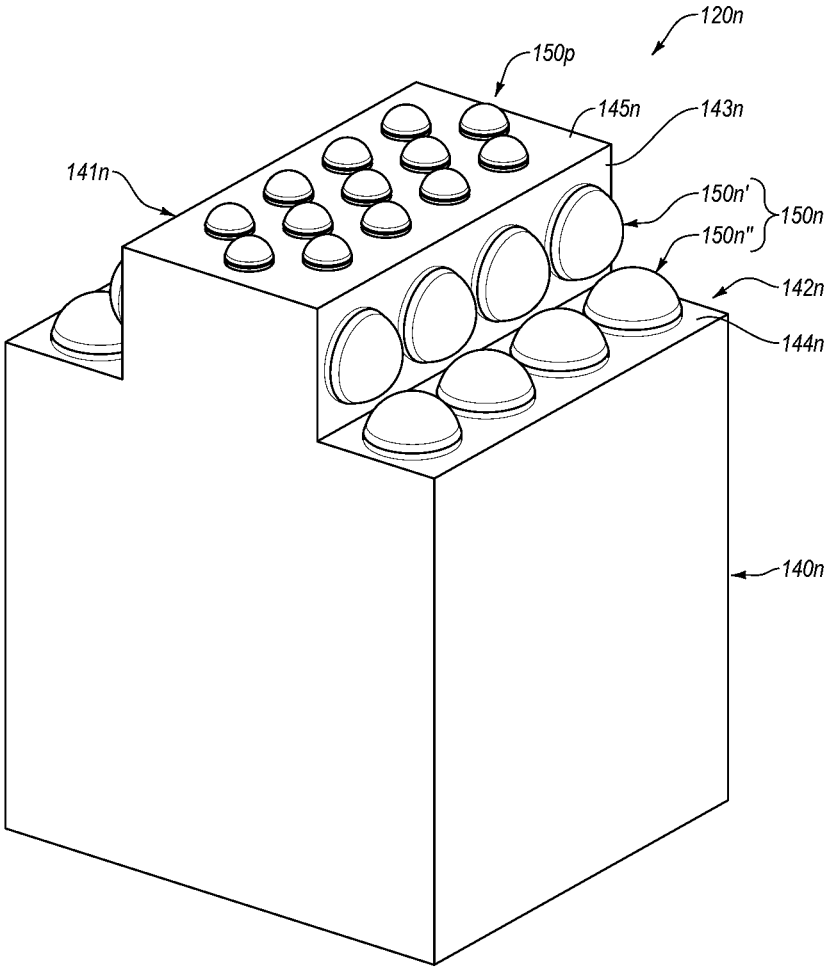
FIG. 4A is an isometric view of a cutter assembly according to an embodiment of the invention.

The shape and size of the support block as well as positions, orientations, shapes, and sizes of the superhard cutter elements may vary from one embodiment to the next. FIG. 4A illustrates yet another embodiment of a cutter assembly 120*n*. More specifically, the cutter assembly 120*n* may include a support block 140*n* and superhard cutter elements 150*n*, 150*p* (not all labeled in FIG. 4A) secured thereto. In some embodiments, the support block 140*n* may have a raised center portion 141*n* that protrudes outward past a base portion 142*n*. The center portion 141*n* may be connected to or integrally formed with the base portion 142*n*. Except as otherwise described herein, the cutter assembly 120*n* and its materials, elements, features, or components may be similar to or the same as any of the cutter assemblies 120, 120*a*, 120*b*, 120*c*, 120*d*, 120*e*, 120*f*, 120*g*, 120*h*, 120*k*, 120*m* (FIGS. 1A-3G) and their respective materials, elements, features, and components.

In an embodiment, at least some of the superhard cutter elements 150*n* may be located on the center portion 141*n* and some may be located on the base portion 142*n*. For example, superhard cutter elements 150*n*' (not all labeled in FIG. 4A) may be located on a generally vertical surface 143*n* of the center portion 141*n*, while superhard cutter elements 150*n*" (not all labeled in FIG. 4A) may be located on a shelf surface 144*n* of the base portion 142*n*. Also, the vertical surface 143*n* may be approximately orthogonal to the shelf surface 144*n*. As such, in some embodiments, center axes of the superhard cutter elements 150*n*' on the vertical surface 143*n* may be oriented orthogonally relative to the superhard cutter elements 150*n*" of the shelf surface 144*n*. In additional or alternative embodiments, center axes of the superhard cutter elements 150*n*' may intersect center axes of superhard cutter elements 150*n*" (e.g., center axes of the superhard elements 150*n*' may be oriented at non-orthogonal angles relative to center axes of the superhard cutter elements 150*n*"). For example, center axes of the superhard cutter elements 150*n*' and superhard cutter elements 150*n*" may form an acute angle therebetween.

Moreover, it should be appreciated that spacing and arrangement of the superhard cutter elements 150*n*' and/or superhard cutter elements 150*n*" may vary from one embodiment to the next. In an embodiment, one, some, or all of the center axes of the superhard cutter elements 150*n*' and/or superhard cutter elements 150*n*" may be substantially parallel with one or more surfaces of the support block 140*n*. For example, at least one of the center axes of the superhard cutter elements 150*n*' may be substantially parallel with the shelf surface 144*n*. Similarly, for example, at least one of the center axes of the superhard cutter elements 150*n*" may be substantially parallel the vertical surface 143*n*.

In an embodiment, the superhard cutter elements 150*n*' and/or superhard cutter elements 150*n*" may have domed (e.g., semispherical or other convex geometry) superhard working surfaces. As noted above, however, this disclosure is not so limited. In particular, the superhard cutter elements 150*n*' and/or superhard cutter elements 150*n*" may have any suitable shape and may be, for example, cone-shaped, pyramid-shaped, and the like. In any event, as the superhard cutter elements 150*n*' and/or superhard cutter elements 150*n*" engage the target material, the superhard cutter elements 150*n*', 150*n*" may pinch, compress, rip, or otherwise fail the target material. Also, as the cutter assembly 120*n* fails the target material, the failed material may slide along the domed superhard working surfaces of the superhard cutter elements 150*n*', 150*n*". Such sliding of the failed material may reduce binding thereof to the superhard cutter elements 150*n*, thereby providing an improved, direct contact of the superhard cutter elements 150*n*' and/or 150*n*" with the target material.

As noted above, the cutter assembly 120*n* may optionally include superhard cutter elements 150*p*. More specifically, in some embodiments, the superhard cutter elements 150*p* may be positioned on a top surface 145*n* of the support block 140*n*. For example, the top surface 145*n* may be substantially planar and the superhard cutter elements 150*p* may be oriented approximately perpendicular to the top surface 145*n*. Consequently, as the cutter assembly 120*n* moves through the target material, the superhard cutter elements 150*p* may engage, cut, rip, or otherwise fail the target material. Moreover, the superhard cutter elements 150*p* may protect the top surface 145*n* from abrasion and wear during operation.

Figure 4B:
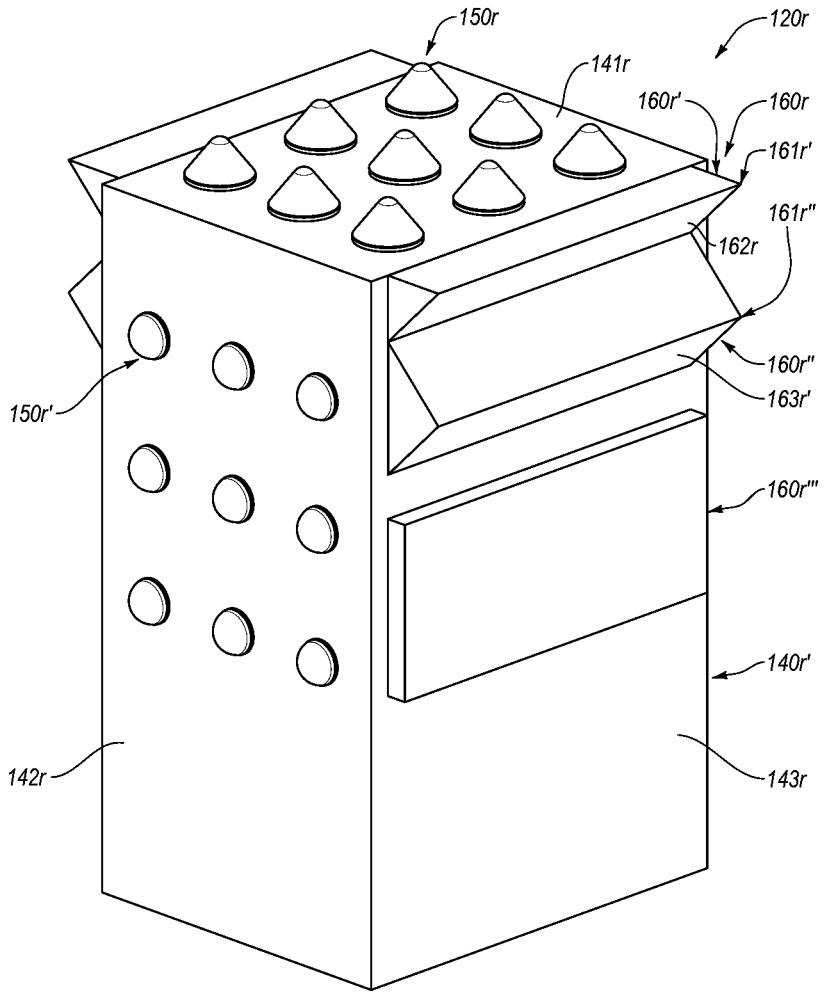
FIG. 4B is an isometric view of a cutter assembly according to an embodiment of the invention.

In some embodiments, the superhard cutter elements 150*p* may be smaller than the superhard cutter elements 150*n*. Thus, in an embodiment, the superhard cutter elements 150*p* may be more densely arranged next to one another than the superhard cutter elements 150*n*. In other words, the superhard cutter elements 150*p* may be configured in any desired manner to provide coverage for the top surface 145*n* (e.g., similar to or different from the configuration of the shelf surface 144*n* provided by the superhard cutter elements 150*n*"). Also, as described above, any of the cutter assemblies described herein may include continuous or elongated superhard wear elements that may span along a surface of the support block, which may be cemented tungsten carbide, such as cobalt-cemented tungsten carbide. Some or at least one of such superhard cutter elements may be or may include polycrystalline diamond compacts. In an embodiment, at least one of the superhard cutter elements may include a tungsten carbide cutter element. For example, FIG. 4B illustrates a cutter assembly 120*r* that may include superhard cutter elements 150*r*, 150*r*' (not all labeled in FIG. 4B) and one or more wear elements 160*r* (e.g., wear elements 160*f*, 160*r*", 160*r*'") secured to a support block 140*r*. Except as otherwise described herein, the cutter assembly 120*r* and its materials, elements, features, or components may be similar to or the same as any of the cutter assemblies 120, 120*a*, 120*b*, 120*c*, 120*d*, 120*e*, 120*f*, 120*g*, 120*h*, 120*k*, 120*m*, 120*n* (FIGS. 1A-4A) and their respective materials, elements, features, and components.

In an embodiment, the support block 140*r* may be a substantially cubic prismoid or cuboid. For example, the superhard cutter elements 150*r* may be positioned on a top surface 141*r* of the support block 140*r* and may be oriented approximately perpendicular thereto. Generally, however, it should be appreciated that arrangement, orientation, positions, and number of the superhard cutter elements may vary from one embodiment to another. Moreover, shapes and sizes of the superhard cutter elements 150*r* also may vary from one embodiment the next. In an embodiment, the superhard cutter elements 150*r* may have an approximately pointed or conical shape (e.g., similar to the shape of the superhard cutter elements 150*a* (FIG. 2A)). Also, the superhard cutter elements 150*r* may be arranged in aligned rows and columns (e.g., in a 3×3 matrix of rows and columns).

As noted above, the cutter assembly 120*r* also may optionally include superhard wear elements 150*r*'. For example, the superhard wear elements 150*r*' may be positioned on a front surface 142*r* of the support block 140*r*. In some embodiments, when the support block 140*r* is mounted on the cutterhead of the TBM (FIG. 1A), the front surface 142*r* may face outward or toward an outside diameter of the cutterhead 110. In such configuration, when the cutterhead 110 (FIG. 1A) rotates and moves the cutter assembly 120*r* through the target material, the superhard wear elements 150*r*' may engage and fail the target material. Additionally or alternatively, the superhard wear elements 150*r*' may protect the front surface 142*r* during operation of the cutter assembly 120*r*.

In some embodiments, the superhard wear elements 150*r*' may be domed (e.g., semispherical or other convex geometry). Also, the superhard wear elements 150*r*' may be smaller than the superhard cutter elements 150*r*, such as exhibit a smaller maximum diameter or other lateral dimension. In any event, however, the superhard wear elements 150*r*' may fail the target material and/or may at least partially protect the front surface 142*r* of the support block 140*r*, thereby extending useful life of the cutter assembly 120*r*.

In some embodiments, the cutter assembly 120*r* may include wear elements 160*r* secured to a side surface 143*r*. As noted above, the cutter assembly 120*r* may have an approximately cuboid shape. Thus, in an embodiment, the wear elements 160*r* may be oriented approximately perpendicular relative to the superhard wear elements 150*f*.

As the cutter assembly 120*r* enters the target material, the wear elements 160*r* also may engage and cut, scrape, or otherwise fail the target material. For example, the wear elements 160*f*, 160*r*" may include multiple corresponding cutting edges 161*r*', 161*r*". In an embodiment, the cutting edges 161*r*', 161*r*" may be at least partially formed by respective slanted working surfaces 162*r*, 163*r*. Moreover, the slanted working surfaces 162*r*, 163*r* may include relief, which may facilitate movement of the excavated material away from the cutting edges 161*r*', 161*r*", thereby allowing the wear elements 160*f*, 160*r*" to effectively engage or scrape target material and/or protect a surface from wear.

As mentioned above, in an embodiment, the cutter assembly 120*r* may include wear elements 160*r*'". The wear elements 160*f*" may be plate-shaped and/or may be approximately rectangular. In an embodiment, the wear elements 160*r*'" may be positioned adjacent to the cutter element 160*r*". Also, in some embodiments, wear elements 160*r* may comprise tungsten carbide (e.g., the wear elements 160*r* may include similar material to the wear elements 160*b* (FIG. 2B)). Accordingly, the wear elements 160*r* may protect the support block 140*r* and more specifically the side surface 143*r* thereof during operation, thereby increasing useful life of the cutter assembly 120*r* (as compared to an embodiment that does not include the wear elements 160*r*).

Figure 5A:
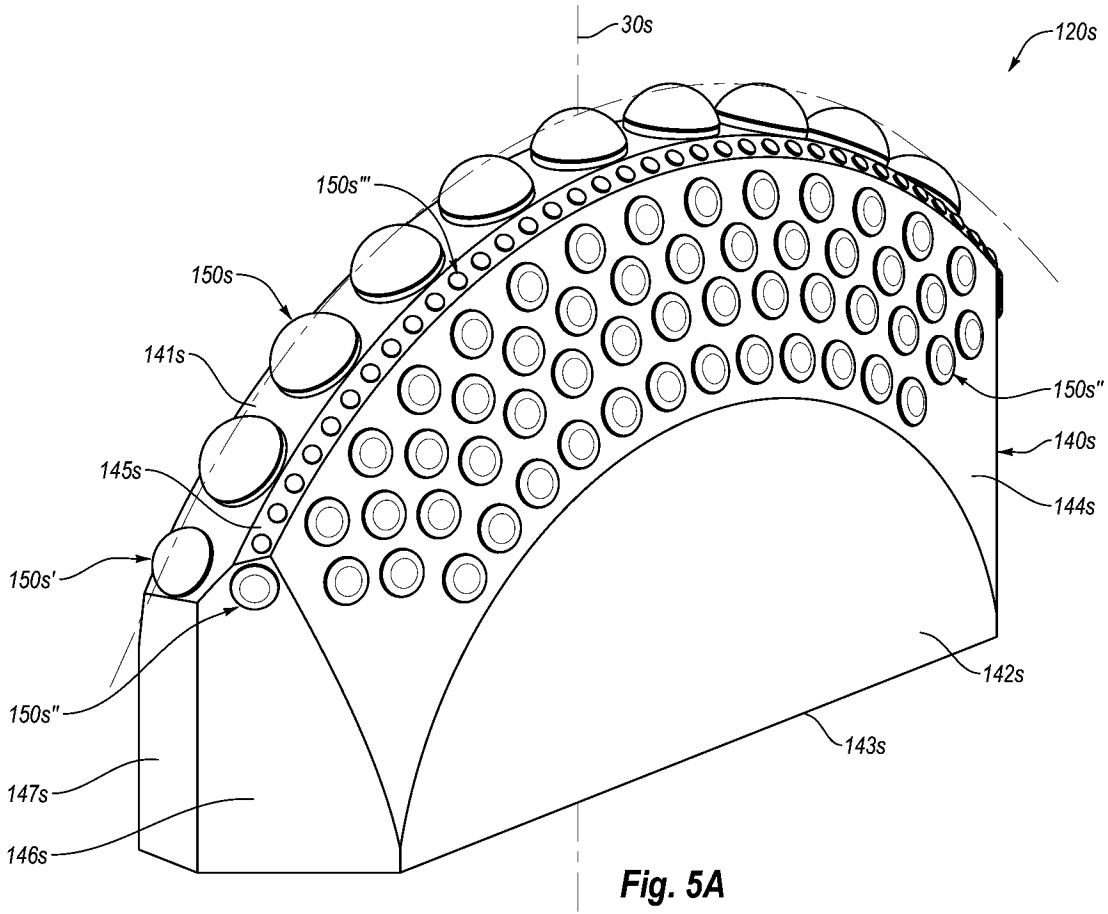
FIG. 5A is an isometric view of a cutter assembly according to an embodiment of the invention.

In some embodiments, the cutter assembly may include one or more curved or arcuate surfaces. Moreover, the superhard cutter elements may protrude to about the same height as one another from such arcuate or curved surface. As such, superhard working surfaces of the superhard cutter elements may lie along the same imaginary curved surface. For example, FIG. 5A illustrates an embodiment of a cutter assembly 120*s* that includes a support block 140*s* and a plurality of superhard cutter elements 150*s* (not all labeled in FIG. 5A) secured thereto. Except as otherwise described herein, the cutter assembly 120*s* and its materials, elements, features, or components may be similar to or the same as any of the cutter assemblies 120, 120*a*, 120*b*, 120*c*, 120*d*, 120*e*, 120*f*, 120*g*, 120*h*, 120*k*, 120*m*, 120*n*, 120*r* (FIGS. 1A-4B) and their respective materials, elements, features, and components. For example, the superhard cutter elements 150*s* may be similar to or the same as the superhard cutter elements 150*g* (FIG. 3D).

In an embodiment, the support block 140*s* may have a curved top surface 141*s*. More specifically, the superhard cutter elements 150*s* may be secured along the curved top surface 141*s* in a manner that may allow at least one of the superhard cutter elements 150*s* to engage the target material during the operation of the TBM. In an embodiment, the curved top surface 141*s* may approximate a portion of an outer surface of a cylinder. Moreover, the support block 140*s* may include a substantially planar vertical surface 142*s*, which may be used to orient and/or position the cutter assembly 120*s* on the cutterhead of the TBM. For example, the vertical surface 142*s* may lie in a plane that is substantially parallel to a centerline 30*s* of the cutter assembly 120*s*.

In some embodiments, the curved top surface 141*s* may be oriented toward the target material when the cutter assembly 120*s* is mounted on the cutterhead 110 (FIG. 1A). Furthermore, in an embodiment, the curved top surface 141*s* may have a peak or a center point that may define the highest point of the curved top surface 141*s* relative to a base surface 143*s* of the support block 140*s*. In some embodiments, the peak of the curved top surface 141*s* may lie on and/or be aligned with the centerline 30*s* of the support block 140*s*. As such, in an embodiment, one half of the curved top surface 141*s* may lie on one side of the centerline 30*s*, while an opposing half may lie on the other side of the centerline 30*s*.

Also, the superhard cutter elements 150*s* may be distributed about the curved top surface 141*s* at approximately equal distances from one another. In an embodiment, a first set of the superhard cutter elements 150*s* may be positioned on one side of the centerline 30*s*, and a second set of the superhard cutter elements 150*s* may be positioned on the opposite side of the centerline 30*s*, while a single superhard cutter element 150*s* may be positioned between the first and second sets of the superhard cutter elements 150*s*.

In some embodiments, one or more of the superhard cutter elements located on the curved top surface may have a different size than one or more other superhard cutter elements located thereon. For example, superhard cutter elements 150*s*' (not all labeled in FIG. 5A) may be positioned on the curved top surface 141*s* at locations remote from the centerline 30*s* and may be smaller than the superhard cutter elements 150*s*.

In addition, the support block 140*s* may have one or more slanted surfaces, such as slanted surfaces 144*s*, 145*s*, 146*s*, or combinations thereof. For example, the slanted surface 144*s* may extend from the vertical surface 142*s* toward the curved top surface 141*s*. In an embodiment, the slanted surface 144*s* may also be curved or arcuate in a manner that generally follows the curvature of the curved top surface 141*s* or other curvature. Moreover, the interface or intersection between the vertical surface 142*s* and the slanted surface 144*s* may lie along an arc. Likewise, interface or intersection between the slanted surfaces 144*s* and 145*s* also may form an arc, which may be approximately congruent with the arc formed between the vertical surface 142*s* and the slanted surface 144*s*.

Furthermore, the surface 144*s* may be oriented at a non-parallel angle relative to the centerline 30. In some embodiments, the surface 144*s* may curve or arc between the surfaces 142*s* and 145*s*. In any event, the interface between the slanted surfaces 145*s* and 144*s* may be closer to the centerline 30*s* than the interface between the slanted surface 144*s* and the vertical surface 142*s*.

In an embodiment, the slanted surface 145*s* may extend between curved top surface 141*s* and the slanted surface 144*s*. For example, the slanted surface 145*s* may be slanted such that the interface or intersection between the curved top surface 141*s* and slanted surface 145*s* is closer to the centerline 30*s* that the interface between the slanted surfaces 145*s* and 144*s*. In some examples, the slanted surface 145*s* may form a chamfer between the slanted surface 144*s* and the curved top surface 141*s*.

In an embodiment, the slanted surface 146*s* may span between the slanted surface 144*s* and a vertical side surface 147*s*. For example, the slanted surface 146*s* may be substantially planar or flat. Additionally or alternatively, the slanted surface 146*s* may be oriented at an angle relative to the vertical surface 142*s*. In an embodiment, the vertical surface 142*s* and the slanted surface 146*s* may form an obtuse angle with an imaginary surface that is tangent to the slanted surface 144*s*. The slanted surface 146*s* also may interface or intersect with the curved top surface 141*s* and slanted surface 144*s*. In any event, in an embodiment, the slanted surface 146*s* may provide a transition between the surfaces 141*s*, 142*s*, 144*s*, 145*s*, 147*s*, or combinations thereof.

In an embodiment, the slanted surfaces 144*s*, 145*s*, 146*s*, or combinations thereof may include one or more superhard cutter elements, such as superhard cutter elements 150*s*" (not all labeled in FIG. 5A). For example, the superhard cutter elements 150*s*" may be positioned in multiple curved rows on the slanted surface 144*s*. In an embodiment, the rows may curve about the same imaginary center point as the curved top surface 141*s*. The superhard cutter elements 150*s*" may have a similar shape as the superhard cutter elements 150*s*. In some embodiments, the superhard cutter elements 150*s*" may be smaller than the superhard cutter elements 150*s*. Optionally, the superhard cutter elements 150*s*" may be arranged more densely on the slanted surface 144*s* than the superhard cutter elements 150*s*. In some embodiments, the superhard cutter elements 150*s*" may protect the slanted surface 144*s* from damage and/or wear during operation of the cutter assembly 120*s*.

In an embodiment, at least one of the superhard cutter elements 150*s*" may be positioned on the slanted surface 146*s*. For example, one of the superhard cutter elements 150*s*" may be positioned near a junction or transition location between the surfaces 141*s*, 144*s*, and 145*s* and the slanted surface 146*s*. Also, in an embodiment, the slanted surface 145*s* may include superhard wear elements 150*s*'" (not all labeled in FIG. 5A) positioned thereon. The superhard wear elements 150*s*'" may protect the slanted surface 145*s* and/or the superhard cutter elements 150*s* from wear and/or damage during operation. In some embodiments, the superhard wear elements 150*s*'" may be oriented approximately perpendicular or normal relative to the slanted surface 145*s*. Also, the superhard wear elements 150*s*'" may have a substantially planar or flat superhard working surface. Optionally, the superhard working surface of each of the superhard wear elements 150*s*'" may be approximately flush or substantially parallel to an area(s) of the slanted surface 145*s* surrounding such superhard working surface.

Figure 5B:
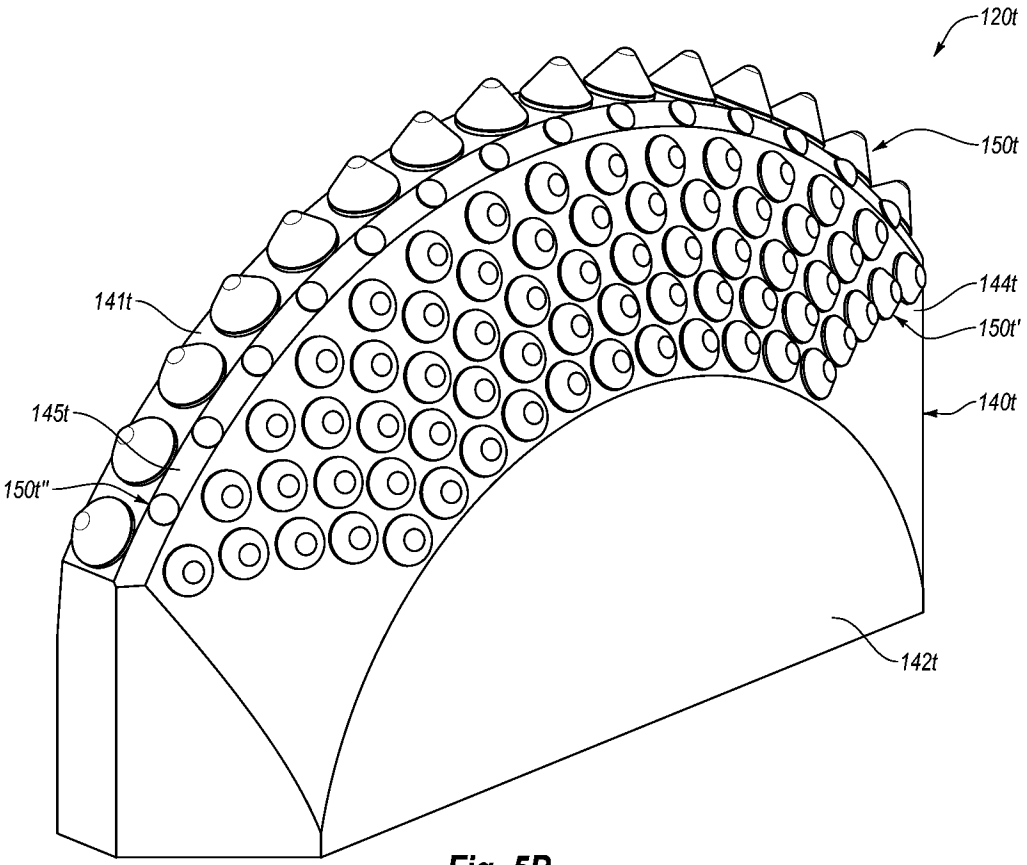
FIG. 5B is an isometric view of a cutter assembly according to an embodiment of the invention.

As noted above, the cutter assemblies may include any number of superhard cutter elements that may have any suitable shapes, sizes, positions, and orientations, which vary from one embodiment to the next. FIG. 5B illustrates another embodiment of a cutter assembly 120*t*, which may include superhard cutter elements 150*t*, 150*t*', 150*t*" (not all labeled in FIG. 5B), or combinations thereof mounted on a support block 140*t*. Except as otherwise described herein, the cutter assembly 120*t* and its materials, elements, features, or components may be similar to or the same as any of the cutter assemblies 120, 120*a*, 120*b*, 120*c*, 120*d*, 120*e*, 120*f*, 120*g*, 120*h*, 120*k*, 120*m*, 120*n*, 120*r*, 120*s* (FIGS. 1A-5A) and their respective materials, elements, features, and components. For example, the support block 140*t* may have a similar or the same shape and/or size as the support block 140*s* (FIG. 5A). Hence, in some embodiments, the support block 140*t* may include surfaces 141*t*, 142*t*, 144*t*, and 145*t*, which may be similar to or the same as the respective surfaces 141*s*, 142*s*, 144*s*, and 145*s* (FIG. 5A).

In some embodiments, the cutter assembly 120*t* also may include superhard cutter elements 150*t* secured on and/or about the surface 141*t*. Additionally, the cutter assembly 120*t* may include superhard cutter elements 150*t*' secured on and/or about the surface 144*t*. Moreover, the superhard cutter elements 150*t*" may be secured on and/or about the surface 145*t*. Generally, the superhard cutter elements 150*t*, 150*t*', 150*t*" may engage the target material in the same or similar manner as the superhard cutter elements 150*s*, 150*s*", 150*s*'" (FIG. 5A).

Any of the superhard cutter elements 150*t*, 150*t*', 150*t*" may have a different shape and/or size than the superhard cutter elements 150*s*, 150*s*", 150*s*'" (FIG. 5A), for example, which may facilitate more aggressive cutting or failing of the target material. In an embodiment, the superhard cutter elements 150*t*, 150*t*' may have an approximately conical shape or may be domed. Additionally or alternatively, the superhard cutter elements 150*t* and/or the superhard cutter elements 150*t*' may have a rounded or semi-spherical tip, which may blend or merge into the conical side surfaces of the superhard cutter elements 150*t*, 150*t*'. Accordingly, the superhard cutter elements 150*t* and/or 150*t*' may have a smaller point or surface of initial contact with the target material and, thereby, may apply a selected force or pressure onto such target material.

Also, in some embodiments, the superhard cutter elements 150*t*" may be approximately semispherical or hemispherical. In any event, as noted above, the particular suitable shape and/or size of the superhard cutter elements may be selected to enhance the operation of the cutter assembly when engaging hard target material (e.g., rocks). Likewise, the support block of the cutter assembly also may include various features, as described herein, which may facilitate failing one or more particular target materials.

Figure 6A:
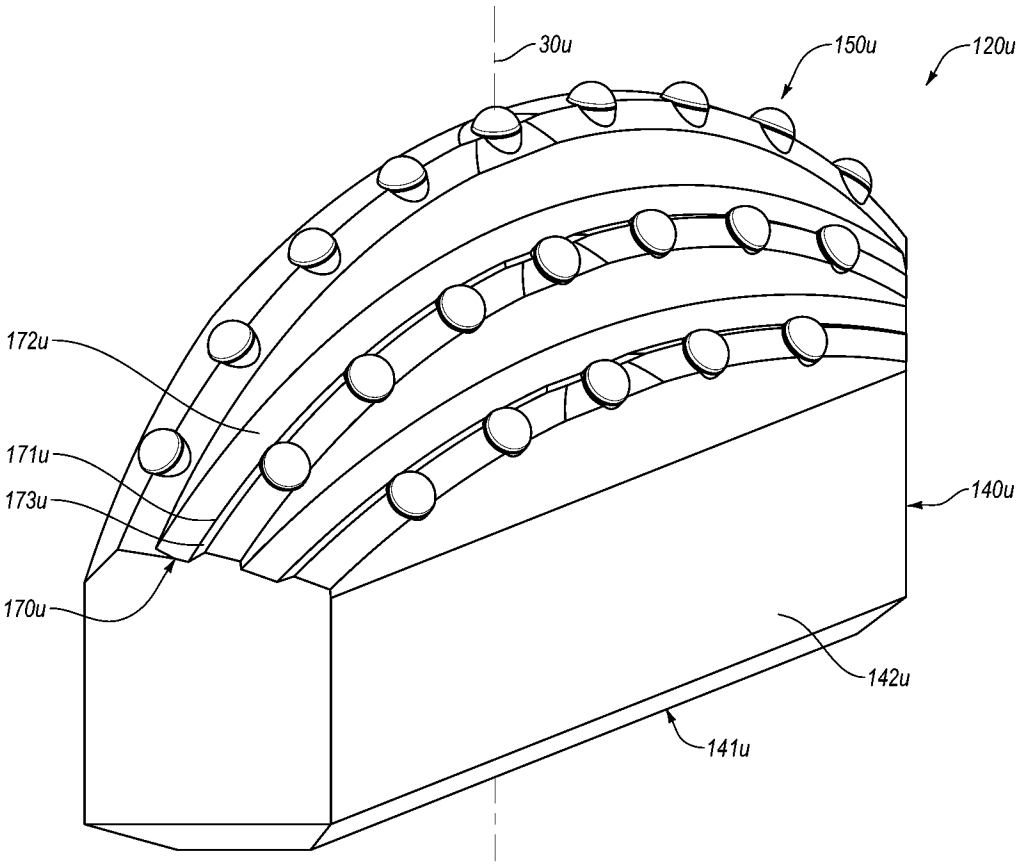
FIG. 6A is an isometric view of a cutter assembly according to an embodiment of the invention.

In an embodiment, the support block may include one or more clearance channels, which may allow failed or excavated material to move away from the superhard cutter elements, thereby extending useful life thereof (e.g., by eliminating or reducing repeated contact with or re-cutting of the failed material). For example, FIG. 6A illustrates a cutter assembly 120*u* that includes superhard cutter elements 150*u* (not all labeled in FIG. 6A) secured to a support block 140*u*. In some embodiments, the superhard cutter elements 150*u* may be positioned in multiple rows having arcuate paths. For example, the rows may have arcuate paths relative to a base 141*u* of the support block 140*u*. Except as otherwise described herein, the cutter assembly 120*u* and its materials, elements, features, or components may be similar to or the same as any of the cutter assemblies 120, 120*a*, 120*b*, 120*c*, 120*d*, 120*e*, 120*f*, 120*g*, 120*h*, 120*k*, 120*m*, 120*n*, 120*r*, 120*s*, 120*t* (FIGS. 1A-5B) and their respective materials, elements, features, and components.

Moreover, at least some of the superhard cutter elements 150*u* may have a non-parallel orientation relative to a vertical surface 142*u* of the support block 140*u*. Accordingly, when the cutter assembly 120*u* is mounted to the cutterhead of the TBM, center axes of at least some of the superhard cutter elements 150*u* may have a non-parallel orientation relative to the rotation axis 10 of the cutterhead 110 (FIG. 1A). In an embodiment, however, center axes of some of the superhard cutter elements 150*u* may have an approximately parallel orientation relative to the vertical surface 142*u* of the support block 140*u*. As such, when the cutter assembly 120*u* is mounted to the cutterhead, center axes of some of the superhard cutter elements 150*u* may be approximately parallel relative to the rotation axis 10 of the cutterhead 110 (FIG. 1A), while other superhard cutter elements 150*u* may form non-parallel angles therewith.

In an embodiment, the cutter assembly 120*u* may include clearance channels 170*u*, which may be positioned between at least some of the adjacent rows of the superhard cutter elements 150*u*. For example, the clearance channels 170*u* may facilitate transfer or movement of the excavated or failed material away from the superhard cutter elements 150*u*, which may reduce unnecessary contact of the superhard cutter elements 150*u* with the excavated material, thereby increasing useful life of the superhard cutter elements 150*u*. In some embodiments, the clearance channels 170*u* may extend between opposing ends of the support block 140*u*. For example, the clearance channels 170*u* may extend approximately laterally between the opposing ends of the support block 140*u*.

In an embodiment, the clearance channels 170*u* may have an approximately arcuate shape relative to the base 141*u*. For example, the clearance channels 170*u* may arc upward, such that the uppermost point of the clearance channels 170*u* is positioned near a centerline 30*u* of the cutter assembly 120*u*. In additional or alternative embodiments, the clearance channels may arc in any number of suitable configurations, and may have alternating or wave-like arcuate shapes. Also, in some embodiments, the clearance channels may follow a straight path, curved path, or combinations thereof.

In an embodiment, the clearance channels 170*u* may arc about a different center point than the arcuate paths of the rows formed by the superhard cutter elements 150*u*. Hence, in some embodiments, a distance from some of the superhard cutter elements 150*u* to the bottom of the adjacent clearance channel 170*u* may be different than the distance from other superhard cutter elements 150*u* to the bottom of the clearance channel 170*u*. For example, the distance to the bottom of the adjacent clearance channel 170*u* from the superhard cutter elements 150*u* closest to the centerline 30*u* of the support block 140*u* may be greater than the distance to the bottom of clearance channel 170*u* from the superhard cutter elements 150*u* farther from the centerline 30*u*.

In an embodiment, the clearance channels 170*u* may include a bottom 171*u* and opposing sides 172*u* and 173*u*, collectively forming, for example, an approximately U-shaped channel. In some embodiments, the bottom 171*u* may have a non-orthogonal orientation relative to the vertical surface 142*u*. For example, the bottom 171*u* may form an acute angle relative to the vertical surface 142*u*.

Also, the sides 172 and/or 173*u* may have non-parallel orientations relative to the vertical surface 142*u*. For example, the side 172*u* may form an acute or obtuse angle relative to the vertical surface 142*u*. It should be appreciated, however, that the sides 172*u*, 173*u*, or combinations thereof may have any number of suitable angles relative to one another as well as relative to surfaces of the support block 140*u* and to the rotation axis of the cutterhead. In any event, the clearance channels 170*u* may be configured in a manner that allows the excavated material to move away from the superhard cutter elements 150*u* along the clearance channels 170*u* (e.g., as new or additional excavated material enters the clearance channels 170*u*).

Figure 6B:
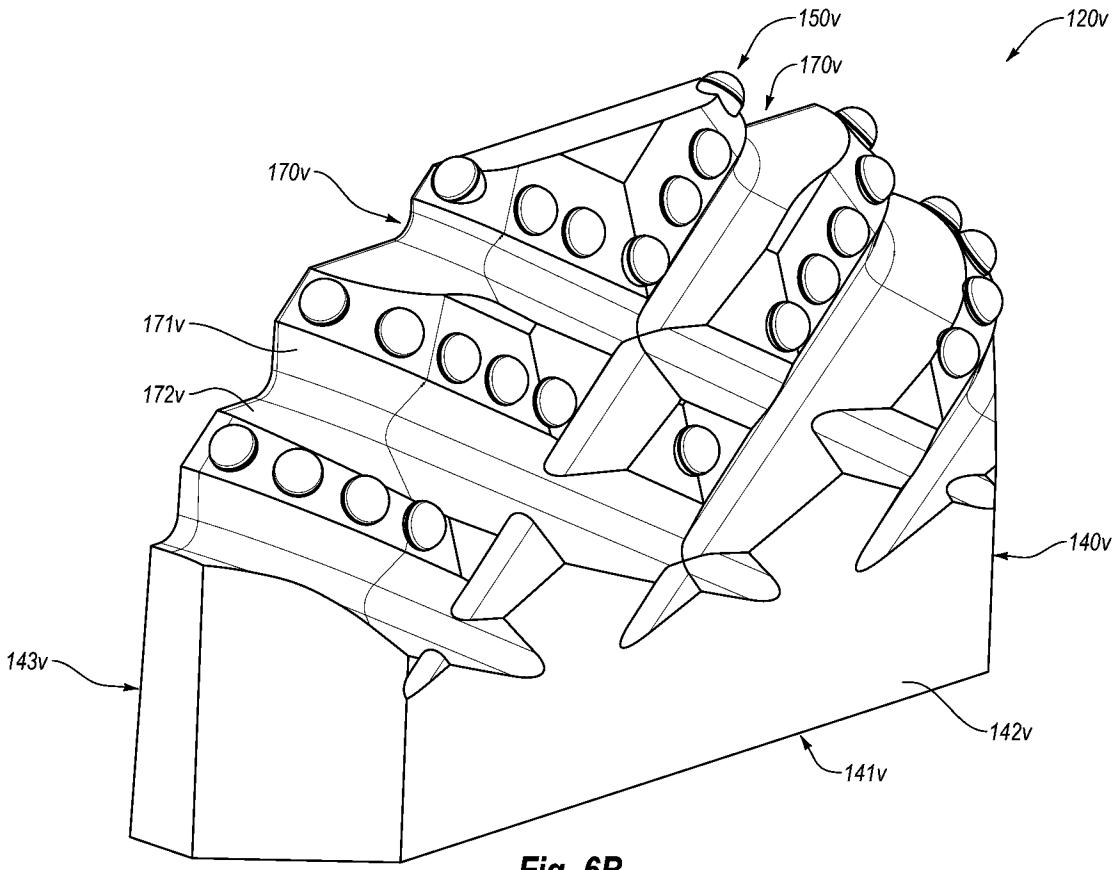
FIG. 6B is an isometric view of a cutter assembly according to an embodiment of the invention.

While in some embodiments the cutter assembly may include one or more arcuate and/or approximately parallel clearance channels, cutter assemblies may include any number of clearance channels that may have any suitable configuration and/or orientation relative to one another as well as relative to the support block of the cutter assembly. The embodiment illustrated in FIG. 6B is a cutter assembly 120*v* that includes clearance channels 170*v* (not all labeled in FIG. 6B) that form crisscross patterns on a support block 140*v* that secure superhard cutter elements 150*v* (not all labeled in FIG. 6B). Except as otherwise described herein, the cutter assembly 120*v* and its materials, elements, features, or components may be similar to or the same as any of the cutter assemblies 120, 120*a*, 120*b*, 120*c*, 120*d*, 120*e*, 120*f*, 120*g*, 120*h*, 120*k*, 120*m*, 120*n*, 120*r*, 120*s*, 120*t*, 120*u* (FIGS. 1A-6A) and their respective materials, elements, features, and components. For example, the superhard cutter elements 150*v* may be arranged in one or more rows aligned along arcuate path, which may be the same as or similar to the arrangement of the superhard cutter elements 150*u* (FIG. 6A).

In an embodiment, the clearance channels 170*v* may pass between superhard cutter elements 150*v*. In particular, the clearance channels 170*v* may pass between adjacent superhard cutter elements 150*v* in the same row (e.g., in a longitudinal row). For example, the clearance channels 170*v* may be oriented at a 45° angle relative to a base 141*v* of the support block 140*v*. Moreover, as noted above, the clearance channels 170*v* may form a crisscross pattern. Optionally, paths of some of the clearance channels 170*v* may form acute angles relative to a reference plane (e.g., relative to a portion of the base 141*v*), while paths of other clearance channels 170*v* may form obtuse angles with the same reference plane (e.g., with the same portion of the base 141*v*). For example, some of the clearance channels 170*v* may be substantially parallel to one another and/or may intersect other clearance channels 170*v* (e.g., the clearance channels 170*v* may intersect at about 90° angles).

In some embodiments, the clearance channels 170*v* may shave a V-shaped cross-section. For example, the clearance channels 170*v* may include two opposing sides 171*v*, 172*v* that may form the V-shape of the clearance channels 170*v*. In some embodiments, the clearance channels 170*v* may include a fillet or radius that extends between the opposing sides 171*v*, 172.

In an embodiment, the clearance channels 170*v* may have an arcuate configuration. That is, the clearance channels 170*v* may extend into the support block 140*v* along an arcuate path. Optionally, in some embodiments, some portions of one or more of the clearance channels 170*v* may be deeper (relative to one or more surfaces of the support block 140*v*) than other portions. For example, portions of the clearance channels 170*v* near a front surface 142*v* of the support block 140*v* may be shallower than portions of the clearance channels 170*v* near a back or mounting surface 143*v* of the support block 140*v*.

In an embodiment, portions of the clearance channels 170*v* located near the superhard cutter elements 150*v* that may have a relatively deeper engagement within the target material may be deeper than the portions of the clearance channels 170*v* located near the superhard cutter elements 150*v* that may have a relatively shallower engagement with the target material. Hence, the clearance channels 170*v* may provide sufficient clearance for the excavated material to move away from the superhard cutter elements 150*v* (e.g., based on the depth of cut of particular superhard cutter elements 150*v*). Moreover, such clearance channels 170*v* may allow the support block 140*v* to maintain sufficient strength and/or rigidity.

The clearance channels 170*v* may form pathways for the excavated material to move away from the superhard cutter elements 150*v* and toward exterior of the cutter assembly 120*v*. For example, as new or additional excavated material enters the clearance channels 170*v*, such material may push other material in the clearance channels 170*v* toward the exterior of the cutter assembly 120*v*. It should be appreciated, however, that the clearance channels 170*v* may have any number suitable orientations relative to one another as well as relative to the base 141*v* of the support block 140*v*. In any event, the excavated material may be moved away from the superhard cutter elements 150*v*, during use.

Figure 7A:
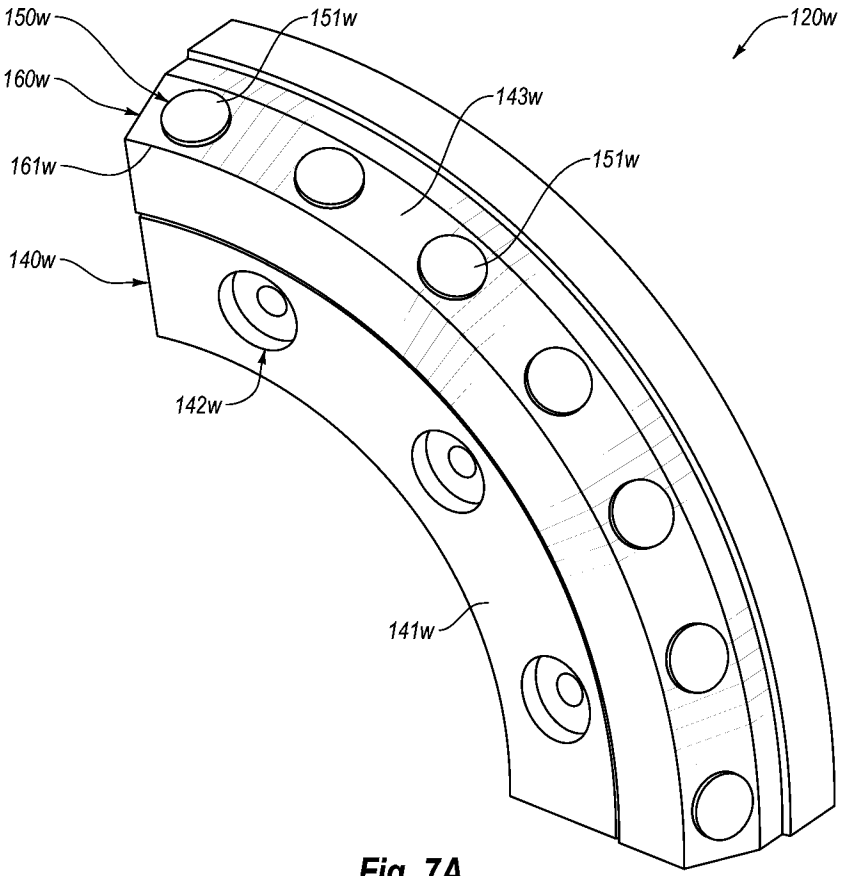
FIG. 7A is an isometric view of a cutter assembly according to an embodiment of the invention.

As mentioned above, the support block of the cutter assembly may have any suitable shape, which may vary from one embodiment to the next, and which may depend, for example, on the particular mounting location on the cutterhead of the TBM and/or on the cutting application (e.g., on the type of target material). FIG. 7A illustrates an embodiment of a cutter assembly 120*w*. More specifically, the cutter assembly 120*w* may include a curved or arcuate support block 140*w* that may secure the superhard cutter elements 150*w* (not all labeled in FIG. 7A). Except as otherwise described herein, the cutter assembly 120*w* and its materials, elements, features, or components may be similar to or the same as any of the cutter assemblies 120, 120*a*, 120*b*, 120*c*, 120*d*, 120*e*, 120*f*, 120*g*, 120*h*, 120*k*, 120*m*, 120*n*, 120*r*, 120*s*, 120*t*, 120*u*, 120*v* (FIGS. 1A-6B) and their respective materials, elements, features, and components.

For example, the support block 140*w* may curve about a center point and may have a semi-circular shape. In an embodiment, the support block 140*w* may include a mounting surface (not shown) and an opposite, vertical surface 141*w*. In one example, the support block 140*w* also may include mounting holes 142*w* (not all labeled in FIG. 7A). Particularly, bolts, screws, or other fasteners may pass through the mounting holes 142*w* and may be screwed into the cutterhead, thereby securing the cutter assembly 120*w* to the cutterhead.

In an embodiment, the cutter assembly 120*w* may include a slanted surface 143*w*, which may be oriented at a non-parallel angle relative to the mounting surface and/or to the vertical surface 141*w*. For example, the slanted surface 143*w* may be at approximately 45° angle to the surface 141*w*. In an embodiment, after mounting the cutter assembly 120*w* to the cutterhead, the surface 143*w* may be oriented at 45° angle to the front surface 111 of the cutterhead 110 (FIG. 1A). It should be appreciated, however, that the slanted surface 143*w* may be oriented at any suitable angle, which may vary from one embodiment to the next.

As described above, the superhard cutter elements 150*w* may be secured to the support block 140*w*. In one example, the superhard cutter elements 150*w* may be secured on and/or about the surface 143*w*. For example, the superhard cutter elements 150*w* may form a row along the slanted surface 143*w*. Moreover, in an embodiment, the slanted surface 143*w* may be curved (e.g., in a manner that follows a semi-circle, which may be centered at the same center point as the shape of the support block 140*w*). Additionally, center axes of at least some of the superhard cutter elements 150*w* may be oriented approximately perpendicular relative to the slanted surface 143*w* (e.g., if the superhard working surfaces 151*w* are planar, they may be approximately parallel or flush relative to the slanted surface 143*w*).

In an embodiment, the superhard cutter elements 150*w* may have approximately planar superhard working surfaces 151*w*. For example, one or more cutting edges may define or encompass the planar superhard working surfaces 151*w* about perimeters thereof. The cutting edges and/or the superhard working surfaces 151*w* may engage and fail the target material.

Also, in some embodiments, the cutter assembly 120*w* may include a wear element 160*w* that may include the slanted surface 143*w*. Moreover, in an embodiment, the superhard cutter elements 150*w* may be attached or bonded to the wear element 160*w*. For example, the wear element 160*w* may include cemented tungsten carbide or similar material. The wear element 160*w* may be permanently or removably secured to the support block 140*w* in any suitable manner, such as by brazing, fastening, press-fitting, etc.

In an embodiment, the wear element 160*w* may include a cutting edge 161*w*, which may engage and/or fail the target material. For example, the superhard working surfaces 151*w* may be positioned higher or above the cutting edge 161*w*, such that the superhard cutter elements 150*w* engage the target material before engagement thereof by the cutting edge 161*w*. Accordingly, in some embodiments, the superhard cutter elements 150*w* may at least partially fail the target material, and the cutting edges 161*w* may scrape and remove the failed material that may still be attached to the bulk of the target material.

In some embodiments, the cutter assembly 120*w* may be mounted on the cutterhead in a manner that rotation of the cutterhead produces movement of the superhard cutter elements 150*w* in a manner that the superhard working surfaces 151*w* of the superhard cutter elements 150*w* engage and fail the target material. For example, the vertical surface 142*w* may be oriented approximately orthogonally relative to the direction of the rotation of the cutterhead. As such, in an embodiment, the superhard cutter elements 150*w* may engage the target material at approximately the same angle as the angle of the slanted surface 143*w*.

Figure 7B:
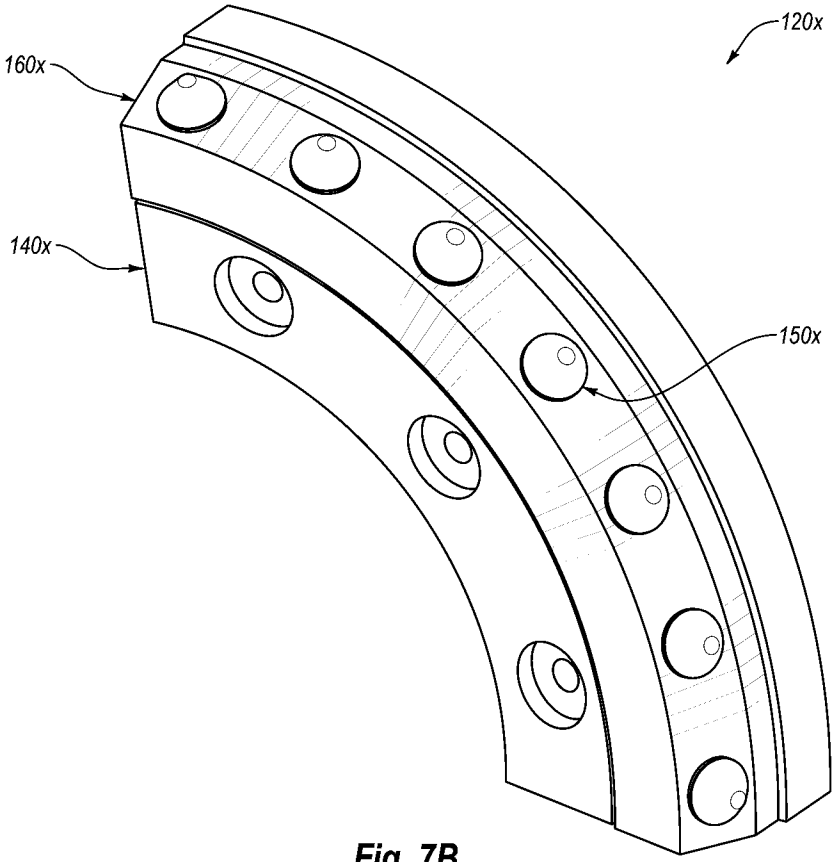
FIG. 7B is an isometric view of a cutter assembly according to an embodiment of the invention.

While the cutter assembly 120*w* described above includes approximately planar superhard cutter elements 150*w*, it should be appreciated that similar cutter assemblies may include superhard cutter elements of any suitable shapes and/or sizes. For example, FIG. 7B, illustrates a cutter assembly 120*x* that include approximately generally pointed superhard cutter elements 150*x*. Except as otherwise described herein, the cutter assembly 120*x* and its materials, elements, features, or components may be similar to or the same as any of the cutter assemblies 120, 120*a*, 120*b*, 120*c*, 120*d*, 120*e*, 120*f*, 120*g*, 120*h*, 120*k*, 120*m*, 120*n*, 120*r*, 120*s*, 120*t*, 120*u*, 120*v*, 120*w* (FIGS. 1A-7A) and their respective materials, elements, features, and components. In an embodiment, the cutter assembly 120*x* may include a support block 140*x* to which the superhard cutter elements 150*x* may be secured. In some embodiments, the support block 140*x* may be similar to or the same as the support block 140*w* (FIG. 7A).

In an embodiment, the superhard cutter elements 150*x* may be designed to engage a different target material (as compared with the superhard cutter elements 150*w* (FIG. 7A)). In particular, the superhard cutter elements 150*x* may provide a point contact with the target material that may exert higher pressure on the target material than, for example, a planar superhard cutter element. As noted above, in some embodiments, a wear element 160*x* (which may be similar to the wear element 160*w* (FIG. 7A)) may scrape and remove the material failed by the superhard cutter elements 150*x*. Moreover, in an embodiment, the superhard cutter elements 150*x* may be secured to or on the wear element 160*x*.

Figure 8:
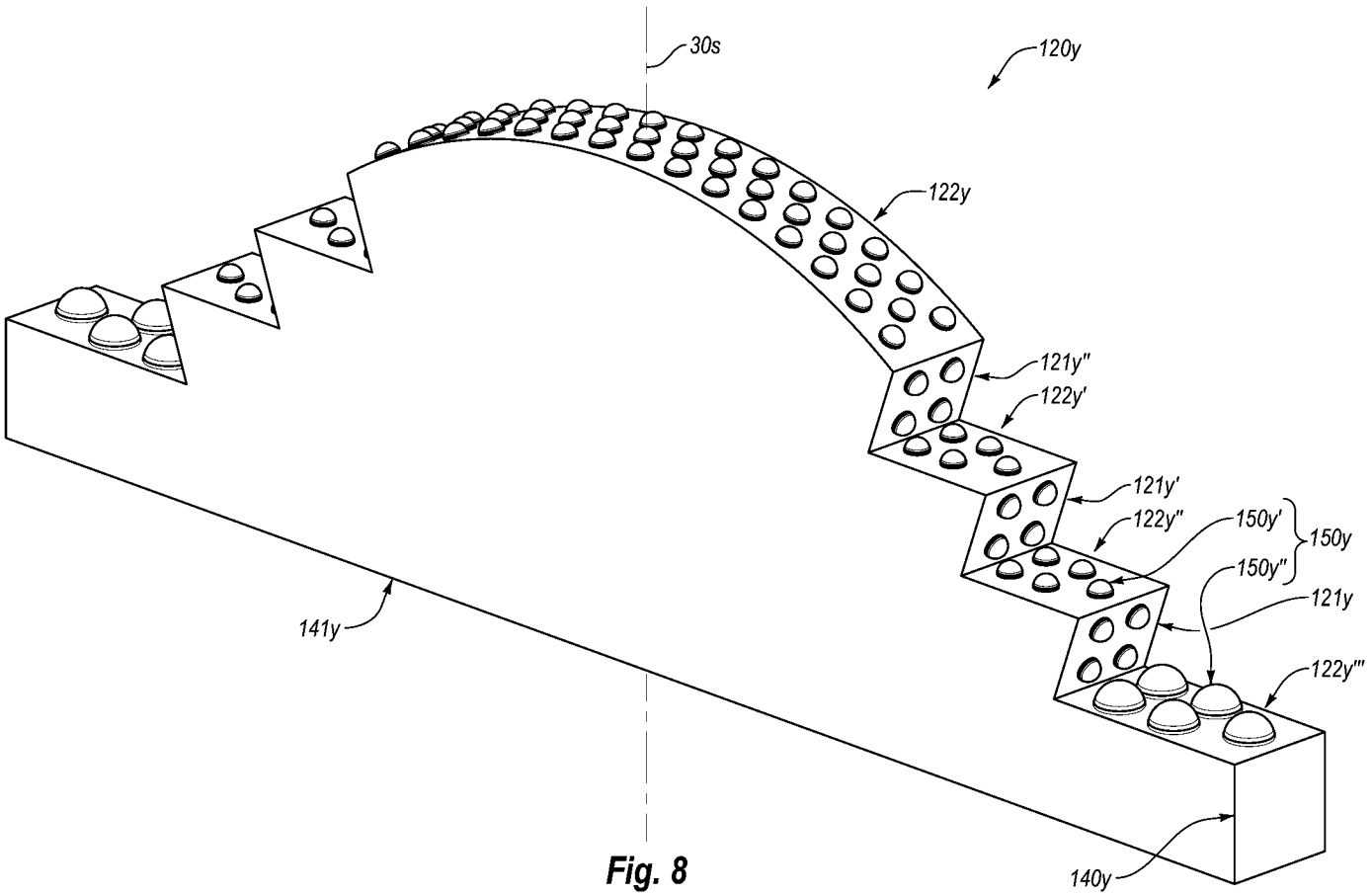
FIG. 8 is an isometric view of a cutter assembly according to an embodiment of the invention.

In some embodiments, the cutter assembly may include multiple or multi-level working or cutting areas. FIG. 8 illustrates a cutter assembly 120*y* that include a support block 140*y*, which has multiple levels to thereby provide multiple locations for mounting superhard cutter elements 150*y* (e.g., superhard cutter elements 150*y*' and 150*y*" (not all labeled in FIG. 8)) and multiple cutting areas. Except as otherwise described herein, the cutter assembly 120*y* and its materials, elements, features, or components may be similar to or the same as any of the cutter assemblies 120, 120*a*, 120*b*, 120*c*, 120*d*, 120*e*, 120*f*, 120*g*, 120*h*, 120*k*, 120*m*, 120*n*, 120*r*, 120*s*, 120*t*, 120*u*, 120*v*, 120*w*, 120*x* (FIGS. 1A-7B) and their respective materials, elements, features, and components.

For example, the cutter assembly 120*y* may include side cutting areas 121*y*, 121*y*', 121*y*", or combinations thereof. In additional or alternative embodiments, the cutter assembly 120*y* also may include top cutting areas 122*y*, 122*y*', 122*y*", 122*y*'", or combinations thereof. In some embodiments, the cutter assembly 120*y* may be approximately symmetric about a centerline 30*y*. Hence, the cutter assembly 120*y* may have symmetric cutting areas (i.e., any of the cutting areas 121*y*, 121*y*', 121*y*", 122*y*, 122*y*', 122*y*", 122*y*'") located on both sides of the centerline 30*y*. Moreover, the cutting areas 121*y*, 121*y*', 121*y*", 122*y*, 122*y*', 122*y*", 122*y*'" may form or define multiple levels of the cutter assembly 120*y*, as shown in FIG. 8.

In some embodiments, one, some, or all of the top cutting areas 122*y*, 122*y*', 122*y*", 122*y*'" may be approximately parallel to a base 141*y* of the support block 140*y*. In other words, when the cutter assembly 120*y* is mounted on the cutterhead of the TBM, one, some, or all of the top cutting areas 122*y*, 122*y*', 122*y*", 122*y*'" may be approximately perpendicular to the rotation axis of the cutterhead. Alternatively, however, any of the top cutting areas 122*y*, 122*y*', 122*y*", 122*y*'" may form non-parallel angles with the base 141*y* and/or with the surface of the cutterhead.

In some embodiments, one, some, or all of the top cutting areas 122*y*, 122*y*', 122*y*", 122*y*'" may have an approximately planar of flat profile. As noted above, the top cutting areas 122*y*, 122*y*', 122*y*", 122*y*" may include superhard cutter elements 150*y*. Specifically, center axes of the superhard cutter elements 150*y* may be oriented approximately parallel relative to the centerline 30*y* or to one another.

Also, in an embodiment, one, some, or all of the top cutting areas 122*y*, 122*y*', 122*y*", 122*y*'" may be at least partially arcuate. For example, the top cutting area 122*y* may arc about a center point. Accordingly, the superhard cutter elements 150*y* of the top cutting area 122*y* may gradually engage the target material, as the cutterhead rotates. It should be appreciated that center axes of one, some, or all of the superhard cutter elements 150*y* of the top cutting area 122*y* may be oriented at non-parallel angles relative to the centerline 30*y*, as the superhard cutter elements 150*y* form arcuate rows or arrangements that may define the arcuate shape of the top cutting area 122*y*.

Also, multiple levels formed by the top cutting areas 122*y*, 122*y*', 122*y*", 122*y*'" may facilitate multi-level engagement and/or cutting or failing of the target material. Thus, the cutter assembly 120*y* may fail the target material in steps or stair patterns, which may reduce load on any single cutting area (e.g., by having other or additional cutting areas fail and/or remove at least some of the target material).

In an embodiment, the side cutting areas 121$y$, 121$y'$, 121$y''$ also may engage and/or fail the target material. Additionally or alternatively, the side cutting areas 121$y$, 121$y'$, 121$y''$ may protect one, some, or all of the top cutting areas 122$y$, 122$y'$, 122$y''$, 122$y'''$ as well as the superhard cutter elements 150$y$ thereof. In any event, in some embodiments, the side cutting areas 121$y$, 121$y'$, 121$y''$ may be substantially planar.

In some embodiments, the plane of the cutting areas 121$y$, 121$y'$, 121$y''$ may have a non-parallel orientation relative to the centerline 30$y$. For example, one, some or all of the side cutting areas 121$y$, 121$y'$, 121$y''$ may form acute angles with one, some, or all of the corresponding top cutting areas 122$y'$, 122$y''$, 122$y'''$ (which may be perpendicular to the centerline 30$y$). Hence, one, some or all of the side cutting areas 121$y$, 121$y'$, 121$y''$ may define or form an angle relative to one, some, or all of the corresponding top cutting areas 122$y$, 122$y'$, 122$y''$, 122$y'''$ that are positioned above the side cutting areas 121$y$, 121$y'$, 121$y''$. The angle may facilitate movement of the failed and/or removed target material away from the top cutting areas 122$y$, 122$y'$, 122$y''$, 122$y'''$. It should be appreciated, however, that the side cutting areas 121$y$, 121$y'$, 121$y''$ may be oriented at any suitable angle (e.g., relative to the centerline 30$y$ and/or relative to the top cutting areas 122$y$, 122$y'$, 122$y''$, 122$y''$), which may vary from one embodiment to the next.

In some embodiments, the superhard cutter elements 150$y'$ and 150$y''$ may be different from each other. For example, the superhard cutter elements 150$y''$ may be bigger than the superhard cutter elements 150$y'$. It should be appreciated that any of the cutting areas 121$y$, 121$y'$, 121$y''$, 122$y$, 122$y'$, 122$y''$, 122$y'''$ may include any of the superhard cutter elements 150$y'$, 150$y''$ or combinations thereof. In one example, the cutting areas 121$y$, 121$y'$, 121$y''$, 122$y$, 122$y'$, 122$y''$ may include the superhard cutter elements 150$y'$, while the cutting area 122$y'$ may include the superhard cutter elements 150$y''$.

Figure 9A:
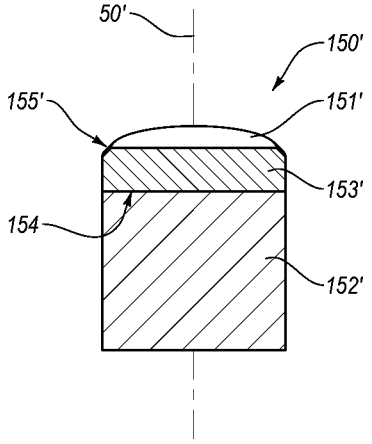
FIG. 9A is a isometric cutaway view of a superhard cutter element according to an embodiment of the invention.
Figure 9B:
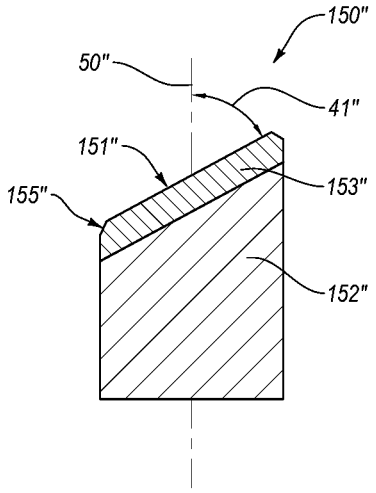
FIG. 9B is a cross-sectional view of a superhard cutter element according to another embodiment of the invention.

As mentioned above, any of the cutter assemblies may include any of the superhard cutter elements described herein. FIGS. 9A-9B illustrate embodiments of superhard cutter elements that may be included in any of the cutter assemblies described above. Specifically, FIG. 9A shows a generally cylindrical superhard cutter element 150' that includes a substantially planar superhard working surface superhard working surface 151'. Except as otherwise described herein, the superhard cutter element 150' and its materials, elements, features, or components may be similar to or the same as any of the superhard cutter elements described above, such as the superhard cutter elements 150, 150$a$, 150$a'$, 150$b$, 150$c$, 150$d$, 150$e$, 150$f$, 150$g$, 150$h$, 150$k$, 150$k'$, 150$m$, 150$m'$, 150$n$, 150$p$, 150$r$, 150$f$, 150$s$, 150$s'$, 150$s''$, 150$s'''$, 150$t$, 150$t'$, 150$t''$, 150$u$, 150$v$, 150$w$, 150$x$, 150$y$ (FIGS. 1A-8) and their respective materials, elements, features, and components.

The superhard cutter element 150' may include a substrate 152' and a superhard table 153', which may be bonded or otherwise secured to the substrate 152'. Specifically, the superhard table 153' may be bonded to the substrate 152' along a planar interface 154'. Alternatively, however, the interface between the superhard table 153' and the substrate may be non-planar.

The superhard table 153' may include the superhard working surface 151'. Furthermore, in some embodiments, the superhard table 153' may have a chamfer 155' extending between the superhard working surface 151' and the peripheral surface of the superhard table 153'; at least a portion of the chamfer 155' also may form or define one or more cutting edges of the superhard cutter element 150'. Additionally or alternatively, the superhard cutter element may include a substantially sharp edge between the superhard working surface and the peripheral surface.

In some embodiments, the superhard working surface 151' and the peripheral surface of the superhard cutter element 150', may form a right cylinder (e.g., the right cylinder may be centered on a center axis 50' of the cutter element 150'). As mentioned above, superhard cutter element 150' may be secured to a support block by positioning the superhard cutter element 150' at least partially within a recess in the support block. Consequently, the superhard working surface 151' may be oriented approximately orthogonally relative to the surface (or center axis thereof) that defines the recess in the support block. As such, the orientation of the superhard working surface 151' relative to the support block may be controlled or determined by the orientation of the recess relative to the support block.

In an embodiment, the superhard table 153' may comprise polycrystalline diamond and the substrate 152' may comprise cobalt-cemented tungsten carbide. Furthermore, in any of the embodiments disclosed herein, the polycrystalline diamond table may be leached to at least partially remove or substantially completely remove a metal-solvent catalyst (e.g., cobalt, iron, nickel, or alloys thereof) that was used to initially sinter precursor diamond particles to form the polycrystalline diamond. In another embodiment, an infiltrant used to re-infiltrate a preformed leached polycrystalline diamond table may be leached or otherwise have a metallic infiltrant removed to a selected depth from a superhard working surface. Moreover, in any of the embodiments disclosed herein, the polycrystalline diamond may be unleached and include a metal-solvent catalyst (e.g., cobalt, iron, nickel, or alloys thereof) that was used to initially sinter the precursor diamond particles that form the polycrystalline diamond and/or an infiltrant used to re-infiltrate a preformed leached polycrystalline diamond table. Examples of methods for fabricating the superhard tables and superhard materials and/or structures from which the superhard tables and elements may be made are disclosed in U.S. Pat. Nos. 7,866,418; 7,998,573; 8,034,136; and 8,236,074; the disclosure of each of the foregoing patents is incorporated herein, in its entirety, by this reference.

The diamond particles that may be used to fabricate the superhard table 153' in a high-pressure/high-temperature process ("HPHT)" may exhibit a larger size and at least one relatively smaller size. As used herein, the phrases "relatively larger" and "relatively smaller" refer to particle sizes (by any suitable method) that differ by at least a factor of two (e.g., 30 μm and 15 μm). According to various embodiments, the diamond particles may include a portion exhibiting a relatively larger size (e.g., 70 μm, 60 μm, 50 μm, 40 μm, 30 μm, 20 μm, 15 μm, 12 μm, 10 μm, 8 μm) and another portion exhibiting at least one relatively smaller size (e.g., 15 μm, 12 μm, 10 μm, 8 μm, 6 μm, 5 μm, 4 μm, 3 μm, 2 μm, 1 μm, 0.5 μm, less than 0.5 μm, 0.1 μm, less than 0.1 μm). In an embodiment, the diamond particles may include a portion exhibiting a relatively larger size between about 10 μm and about 40 μm and another portion exhibiting a relatively smaller size between about 1 μm and 4 μm. In another embodiment, the diamond particles may include a portion exhibiting the relatively larger size between about 15 μm and about 50 μm and another portion exhibiting the relatively smaller size between about 5 μm and about 15 μm. In another embodiment, the relatively larger size diamond particles may have a ratio to the relatively smaller size diamond particles of at least 1.5. In some embodiments, the diamond particles may comprise three or more different sizes (e.g., one relatively larger size and two or more relatively smaller sizes), without limitation. The resulting polycrystalline diamond formed from HPHT sintering the aforementioned diamond particles may also exhibit the same or similar diamond grain size distributions and/or sizes as the aforementioned diamond particle distributions and particle sizes. Additionally, in any of the embodiments disclosed herein, the superhard elements may be free-standing (e.g., substrateless) and/or formed from a polycrystalline diamond body that is at least partially or fully leached to remove a metal-solvent catalyst initially used to sinter the polycrystalline diamond body.

As noted above, the superhard table 153' may be bonded to the substrate 152'. For example, the superhard table 153' comprising polycrystalline diamond may be at least partially leached and bonded to the substrate 152' with an infiltrant exhibiting a selected viscosity, as described in U.S. patent application Ser. No. 13/275,372, entitled "Polycrystalline Diamond Compacts, Related Products, And Methods Of Manufacture," the entire disclosure of which are incorporated herein by this reference. In an embodiment, at least partially leached polycrystalline diamond table may be fabricated by subjecting a plurality of diamond particles (e.g., diamond particles having an average particle size between 0.5 μm to about 150 μm) to an HPHT sintering process in the presence of a catalyst, such as cobalt, nickel, iron, or an alloy of any of the preceding metals to facilitate intergrowth between the diamond particles and form a polycrystalline diamond table comprising bonded diamond grains defining interstitial regions having the catalyst disposed within at least a portion of the interstitial regions. The as-sintered polycrystalline diamond table may be leached by immersion in an acid or subjected to another suitable process to remove at least a portion of the catalyst from the interstitial regions of the polycrystalline diamond table, as described above. The at least partially leached polycrystalline diamond table includes a plurality of interstitial regions that were previously occupied by a catalyst and form a network of at least partially interconnected pores. In an embodiment, the sintered diamond grains of the at least partially leached polycrystalline diamond table may exhibit an average grain size of about 20 μm or less. Subsequent to leaching the polycrystalline diamond table, the at least partially leached polycrystalline diamond table may be bonded to a substrate in an HPHT process via an infiltrant with a selected viscosity. For example, an infiltrant may be selected that exhibits a viscosity that is less than a viscosity typically exhibited by a cobalt cementing constituent of typical cobalt-cemented tungsten carbide substrates (e.g., 8% cobalt-cemented tungsten carbide to 13% cobalt-cemented tungsten carbide).

Additionally or alternatively, the superhard table 153' may be a polycrystalline diamond table that has a thermally-stable region, having at least one low-carbon-solubility material disposed interstitially between bonded diamond grains thereof, as further described in U.S. patent application Ser. No. 13/027,954, entitled "Polycrystalline Diamond Compact Including A Polycrystalline Diamond Table With A Thermally-Stable Region Having At Least One Low-Carbon-Solubility Material And Applications Therefor," the entire disclosure of which are incorporated herein by this reference. The low-carbon-solubility material may exhibit a melting temperature of about 1300° C. or less and a bulk modulus at 20° C. of less than about 150 GPa. The low-carbon-solubility, in combination with the high diamond-to-diamond bond density of the diamond grains, may enable the low-carbon-solubility material to be extruded between the diamond grains and out of the polycrystalline diamond table before causing the polycrystalline diamond table to fail during operations due to interstitial-stress-related fracture.

In some embodiments, the polycrystalline diamond, which may form the superhard table 153', may include bonded-together diamond grains having aluminum carbide disposed interstitially between the bonded-together diamond grains, as further described in U.S. patent application Ser. No. 13/100,388, entitled "Polycrystalline Diamond Compact Including A Polycrystalline Diamond Table Containing Aluminum Carbide Therein And Applications Therefor," the entire disclosure of which are incorporated herein by this reference.

While in some embodiments the superhard cutter element may include a working surface that is approximately orthogonal to the peripheral surface thereof, the present disclosure is not so limited. Particularly, FIG. 9B illustrates a superhard cutter elements 150" that includes a slanted superhard working surface 151". Except as otherwise described herein, the superhard cutter elements 150" and its materials, elements, features, or components may be similar to or the same as any of the superhard cutter elements described above, such as the superhard cutter elements 150, 150*a*, 150*a'*, 150*b*, 150*c*, 150*d*, 150*e*, 150*f*, 150*g*, 150*h*, 150*k*, 150*k'*, 150*m*, 150*m'*, 150*n*, 150*p*, 150*r*, 150*f*, 150*s*, 150*s'*, 150*s"*, 150*s'"*, 150*t*, 150*t'*, 150*t"*, 150*u*, 150*v*, 150*w*, 150*x*, 150*y*, 150' (FIGS. 1A-9A) and their respective materials, elements, features, and components. For example, the superhard working surface 151" may be substantially planar and may be similar to the superhard working surface 151' (FIG. 9A) and may be formed by a superhard table 153" that may be bonded to a substrate 152". Furthermore, in some embodiments, the superhard cutter element 150" may include a chamfer 155", which may be similar to or the same as the chamfer 155' (FIG. 9A) and may extend about at least a portion of the superhard working surface 151". Alternatively or additionally, the superhard cutter element 150" may include a sharp edge extending about at least a portion of the superhard working surface 151" and formed by and between the superhard working surface 151" and the peripheral surface of the superhard table 153".

The superhard working surface 151" may have any suitable orientation relative to the peripheral surface of the superhard cutter elements 150" and/or centerline about which the peripheral surface spans. For example, the peripheral surface of the superhard cutter elements 150" may span about a center axis 50". Hence, in an embodiment, the superhard working surface 151" may be oriented at an acute slant angle 41" relative to the center axis 50". As noted above, however, the superhard working surface 151" may have any suitable orientation and slant angle. Furthermore, in some embodiments, the superhard cutter elements may have non-planar superhard working surfaces and/or may have non-planar interfaces between the substrate and the superhard table 153".

Figure 9C:
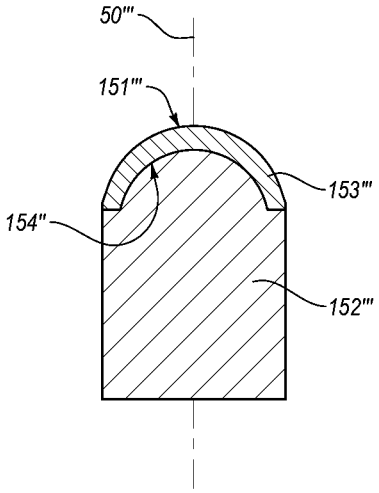
FIG. 9C is a cross-sectional view of a superhard cutter element according to yet another embodiment of the invention.

For example, FIG. 9C illustrates a superhard cutter elements 150'" that has a non-planar superhard working surface 151'". Moreover, the superhard working surface 151'" is included in a superhard table 153'" that is bonded to a substrate 152'" along an at least partially non-planar interface 154'". Except as otherwise described herein, the superhard cutter elements 150'" and its materials, elements, features, or components may be similar to or the same as any of the superhard cutter elements described above, such as the superhard cutter elements 150, 150*a*, 150*a'*, 150*b*, 150*c*, 150*d*, 150*e*, 150*f*, 150*g*, 150*h*, 150*k*, 150*k'*, 150*m*, 150*m'*,

150*n*, 150*p*, 150*r*, 150*r*', 150*s*, 150*s*', 150*s*", 150*s*'", 150*t*, 150*t*', 150*t*", 150*u*, 150*v*, 150*w*, 150*x*, 150*y*, 150', 150" (FIGS. 1A-9B) and their respective materials, elements, features, and components.

In an embodiment, the superhard working surface 151'" may have a domed, hemispherical or semispherical shape that, in some examples, may be centered about a center axis 50'". Similarly, the interface 154'" between the superhard table 153'" and the substrate 152'" may be at least partially domed, hemispherical or semispherical. For example, the semispherical portion of the interface 154'" and the superhard working surface 151'" may be centered about the same or similar center point. As such, at least a portion of the superhard table 153'" may have an approximately uniform thickness.

Moreover, in some embodiments, the interface 154'" may include non-spherical portions (e.g., planar, irregular, etc.). Similarly, the superhard working surface 151'" may include other non-planar shapes. It should be also appreciated that any of the superhard cutter elements may include multiple superhard working surfaces, which may be included in or formed by the superhard tables. In other words, one or more of the superhard working surfaces of the superhard cutter elements may vary from one embodiment to the next and may be shaped, sized, or otherwise configured to facilitated cutting, scraping, or otherwise failing the target material, when the superhard cutter element is included in an operating cutter assembly.

Figure 9D:
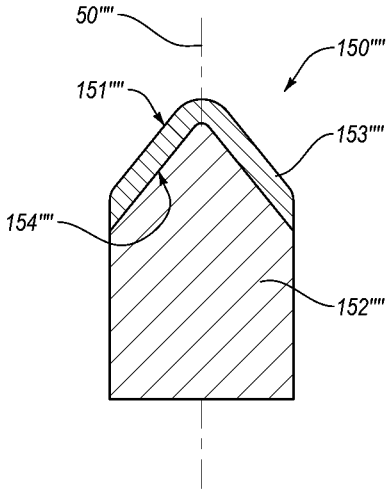
FIG. 9D is a cross-sectional view of a superhard cutter element according to yet another embodiment of the invention.

In at least one embodiment, as shown in FIG. 9D, a superhard cutter element 150' may have a generally pointed superhard working surface 151'. Except as otherwise described herein, the superhard cutter elements 150' and its materials, elements, features, or components may be similar to or the same as any of the superhard cutter elements described above, such as the superhard cutter elements 150, 150*a*, 150*a*', 150*b*, 150*c*, 150*d*, 150*e*, 150*f*, 150*g*, 150*h*, 150*k*, 150*k*', 150*m*, 150*m*', 150*n*, 150*p*, 150*r*, 150*f*, 150*s*, 150*s*', 150*s*", 150*s*'", 150*t*, 150*t*', 150*t*", 150*u*, 150*v*, 150*w*, 150*x*, 150*y*, 150', 150", 150'" (FIGS. 1A-9C) and their respective materials, elements, features, and components.

For example, the superhard cutter element 150"" may include a superhard table 153"" bonded to a substrate 152"". In an embodiment, the substrate 152"" may be generally cylindrical and/or may be centered about a center axis 50"". Also, in at least one embodiment, at least a portion of the superhard table 153"" may have an approximately uniform thickness (e.g., an interface 154"" between the superhard table 153"" and the substrate 152"" may approximately follow the working surface 151"").

While various aspects and embodiments have been disclosed herein, other aspects and embodiments are contemplated. The various aspects and embodiments disclosed herein are for purposes of illustration and are not intended to be limiting. Additionally, the words "including," "having," and variants thereof (e.g., "includes" and "has") as used herein, including the claims, are open ended and shall have the same meaning as the word "comprising" and variants thereof (e.g., "comprise" and "comprises").

We claim:

1. A cutter assembly for mounting on a cutterhead of a tunnel boring machine ("TBM") and engaging a target material, the cutter assembly comprising:

a support block sized and configured to be attached to the cutterhead of the TBM, the support block including a top surface and one or more side surfaces that include a leading surface;

one or more wear elements secured to the support block; and a plurality of polycrystalline diamond cutter elements, each of the plurality of polycrystalline diamond cutter elements including a polycrystalline diamond working surface, the plurality of polycrystalline diamond cutter elements including:

one or more first polycrystalline diamond elements having nonplanar diamond working surfaces and extending outward from the top surface of the support block; and one or more second polycrystalline diamond elements having substantially planar working surfaces, wherein a center axis of the one or more second polycrystalline diamond elements is oriented at an acute angle relative to a centerline of the support block.

2. The cutter assembly of claim 1, wherein at least some of the plurality of polycrystalline diamond cutter elements include respective center axes oriented non-parallel relative to at least some other polycrystalline diamond cutter elements of the plurality of polycrystalline diamond cutter elements.

3. The cutter assembly of claim 1, wherein at least one polycrystalline diamond cutter element of the plurality of polycrystalline diamond cutter elements includes tungsten carbide.

4. The cutter assembly of claim 1, further comprising at least one superhard cutter element that includes a tungsten carbide working surface.

5. The cutter assembly of claim 1, wherein the support block includes one or more clearance channels sized and configured for excavated and/or failed material to move therethrough.

6. The cutter assembly of claim 5, wherein at least some clearance channels of the one or more clearance channels intersect other clearance channels of the one or more clearance channels.

7. The cutter assembly of claim 1, wherein the support block includes steel.

8. The cutter assembly of claim 1, wherein the one or more wear elements includes tungsten carbide.

9. The cutter assembly of claim 1, wherein at least one of the one or more wear elements are located, sized, and configured to protect at least a portion of the support block from wear during cutting operations.

10. The cutter assembly of claim 9, wherein the support block has a lateral dimension, and at least one of the one or more wear elements extends substantially laterally across the support block.

11. The cutter assembly of claim 1, wherein at least some of the polycrystalline diamond working surfaces are substantially planar, domed, generally conical, or pointed.

12. The cutter assembly of claim 1, wherein the top surface and the leading surface are oriented at an acute angle relative to each other.

13. The cutter assembly of claim 1, wherein the rake angle is between 1 degree and 30 degrees.

14. The cutter assembly of claim 1, wherein the support block includes a longitudinal centerline, a crosswise centerline that is substantially perpendicular to the longitudinal centerline, and wherein the centerline is substantially perpendicular to the longitudinal centerline and the crosswise centerline, wherein the center axis of each of the one or more second polycrystalline diamond elements is oriented at an acute angle with an imaginary plane formed by the centerline and the crosswise centerline.

15. A tunnel boring machine ("TBM") for engaging, failing, and excavating target material, the TBM comprising:

a rear portion configured to be secured relative to the target material;

a cutterhead rotatably connected to the rear portion, the cutterhead having a front surface, the cutterhead being moveable into the target material; and a plurality of cutter assemblies secured to the cutterhead and positioned and oriented on the cutterhead in a manner to engage target material during rotation of the cutterhead, each of the plurality of cutter assemblies including:

a support block including a top surface and one or more side surfaces that include a leading surface;

one or more wear elements secured to the support block; and a plurality of polycrystalline diamond cutter elements secured to the support block, the plurality of polycrystalline diamond cutter elements including:

one or more first polycrystalline diamond elements having nonplanar diamond working surfaces and extending outward from the top surface of the support block; and one or more second polycrystalline diamond elements having substantially planar working surfaces, wherein a center axis of the one or more second polycrystalline diamond elements is oriented at an acute angle relative to a centerline of the support block.

16. The TBM of claim 15, wherein each of the plurality of polycrystalline diamond cutter elements includes a superhard working surface that includes polycrystalline diamond.

17. The TBM of claim 16, wherein the one or more wear elements include tungsten carbide or a steel having a hardness of at least 32 HRC.

18. A cutterhead for a tunnel boring machine, the cutterhead comprising:

a front surface oriented approximately perpendicular to a rotation axis;

a plurality of cutter assemblies protruding outward from the front surface, each of the plurality of cutter assemblies including:

a support block including a top surface and one or more side surfaces that include a leading surface;

one or more wear elements secured to the support block; and a plurality of polycrystalline diamond cutter elements secured to the support block, the plurality of polycrystalline diamond cutter elements including:

one or more first polycrystalline diamond elements having nonplanar diamond working surfaces and extending outward from the top surface of the support block; and one or more second polycrystalline diamond elements having substantially planar working surfaces, wherein a center axis of the one or more second polycrystalline diamond elements oriented at an acute angle relative to a centerline of the support block.

* * * * *